US011655701B2

(12) United States Patent
Forshaw et al.

(10) Patent No.: US 11,655,701 B2
(45) Date of Patent: May 23, 2023

(54) AUTONOMOUS TORQUE AND DRAG MONITORING

(71) Applicants: Matthew Forshaw, Celle (DE); Joern Koeneke, Burgdorf (DE); Gerald Becker, Celle (DE)

(72) Inventors: Matthew Forshaw, Celle (DE); Joern Koeneke, Burgdorf (DE); Gerald Becker, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/864,802

(22) Filed: May 1, 2020

(65) Prior Publication Data

US 2021/0340856 A1 Nov. 4, 2021

(51) Int. Cl.

| | |
|---|---|
| ***E21B 44/04*** | (2006.01) |
| ***E21B 7/04*** | (2006.01) |
| ***E21B 21/08*** | (2006.01) |

(52) U.S. Cl.

CPC ..... *E21B 44/04* (2013.01); *E21B 7/04* (2013.01); *E21B 21/08* (2013.01); *E21B 2200/20* (2020.05)

(58) Field of Classification Search

CPC . E21B 44/04; E21B 7/04; E21B 21/08; E21B 2200/20

See application file for complete search history.

(56) References Cited

U.S. PATENT DOCUMENTS

| | | | |
|---|---|---|---|
| 4,660,656 | A | 4/1987 | Warren et al. |
| 4,760,735 | A | 8/1988 | Sheppard et al. |
| 4,903,245 | A | 2/1990 | Close et al. |
| 7,100,708 | B2 | 9/2006 | Koederitz |
| 7,114,578 | B2 | 10/2006 | Hutchinson |
| 7,748,474 | B2 | 7/2010 | Watkins et al. |
| 8,752,648 | B2 | 6/2014 | Goebel et al. |

(Continued)

FOREIGN PATENT DOCUMENTS

| | | | |
|---|---|---|---|
| WO | 2018152636 | A1 | 8/2018 |

OTHER PUBLICATIONS

International Search Report Issued in International Application No. PCT/US2021/0229880 dated Aug. 6, 2021; 4 Pages.

(Continued)

*Primary Examiner* — Dany E Akakpo
(74) *Attorney, Agent, or Firm* — Cantor Colburn LLP

(57) ABSTRACT

Examples described herein provide a computer-implemented method that includes modeling at least one torque and drag parameter for an upstream well construction operation. The method further includes acquiring at least one measured torque and drag parameter during performing the upstream well construction operation. The method further includes interpolating friction factors at different sampling times for the at least one measured torque and drag parameter. The method further includes transposing the friction factors at the different sampling times for the at least one measured torque and drag parameter to a time-based series. The method further includes performing a corrective action responsive to determining that one or more of the friction factors at a particular point in time is indicative of the one or more of the friction factors deviating from an expected value.

19 Claims, 17 Drawing Sheets

(56) References Cited

U.S. PATENT DOCUMENTS

| | | | | |
|---|---|---|---|---|
| 9,145,768 | B2 | 9/2015 | Normore et al. | |
| 9,279,318 | B2 | 3/2016 | Hay et al. | |
| 9,482,083 | B2 | 11/2016 | Doris | |
| 10,100,580 | B2 | 10/2018 | Reckmann et al. | |
| 2011/0153217 | A1 | 6/2011 | Rodney | |
| 2012/0048621 | A1 | 3/2012 | Stewart et al. | |
| 2013/0049981 | A1 | 2/2013 | Macpherson et al. | |
| 2013/0277111 | A1 | 10/2013 | Edbury et al. | |
| 2014/0196949 | A1* | 7/2014 | Hareland | E21B 44/00 175/27 |
| 2015/0134257 | A1 | 5/2015 | Erge et al. | |
| 2016/0281490 | A1 | 9/2016 | Smauel | |
| 2017/0009543 | A1 | 1/2017 | Lovorn et al. | |
| 2019/0178059 | A1 | 6/2019 | Zheng et al. | |
| 2021/0148215 | A1* | 5/2021 | Jamison | E21B 44/00 |

OTHER PUBLICATIONS

Written Opinion Issued in International Application No. PCT/US2021-0229880 dated Aug. 6, 2021; 3 Pages.

* cited by examiner

| PU HKLD (kft.lbs) | FF (unitless) | Sample Time |
|---|---|---|
| 36 | 0.29 | 1200hrs |
| 37 | 0.21 | 1300hrs |
| 42 | 0.27 | 1345hrs |
| 48 | 0.32 | 1420hrs |
| 49 | 0.32 | 1500hrs |
| 52 | 0.37 | 1525hrs |

AUTONOMOUS TORQUE AND DRAG MONITORING

BACKGROUND

Embodiments described herein relate generally to downhole exploration and production efforts and more particularly to techniques for performing autonomous torque and drag monitoring.

Downhole exploration and production efforts involve the deployment of a variety of sensors and tools. The sensors provide information about the downhole environment, for example, by collecting data about temperature, density, saturation, and resistivity, among many other parameters. This information can be used to control aspects of drilling and tools or systems located in the bottom hole assembly, along the drillstring, or on the surface.

SUMMARY

Embodiments of the present invention are directed to performing autonomous four-dimensional torque and drag monitoring.

A non-limiting example computer-implemented method for performing autonomous four-dimensional torque and drag monitoring includes modeling at least one torque and drag parameter for an upstream well construction operation. The method further includes acquiring at least one measured torque and drag parameter during performing the upstream well construction operation. The method further includes interpolating friction factors at different sampling times for the at least one measured torque and drag parameter. The method further includes transposing the friction factors at the different sampling times for the at least one measured torque and drag parameter to a time-based series. The method further includes performing a corrective action responsive to determining that one or more of the friction factors at a particular point in time is indicative of the one or more of the friction factors deviating from an expected value.

A non-limiting example system includes a memory comprising computer readable instructions and a processing device for executing the computer readable instructions, the computer readable instructions controlling the processing device to perform operations. The operations include modeling at least one torque and drag parameter for an upstream well construction operation. The operations further include acquiring at least one measured torque and drag parameter during performing the upstream well construction operation. The operations further include interpolating friction factors at different sampling times for at least one measured torque and drag parameter. The operations further include transposing the friction factors at the different sampling times for at least one measured torque and drag parameter to a time-based series. The operations further include performing a corrective action responsive to determining that one or more of the friction factors at a particular point in time is indicative of the one or more of the friction factors deviating from an expected value.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

Referring now to the drawings wherein like elements are numbered alike in the several figures.

DETAILED DESCRIPTION

Modern bottom hole assemblies (BHAs) are composed of several distributed components, such as sensors and tools, with each component performing data acquisition and/or processing of a special purpose. Examples of types of data acquired can include torque and drag data.

Figure 1:
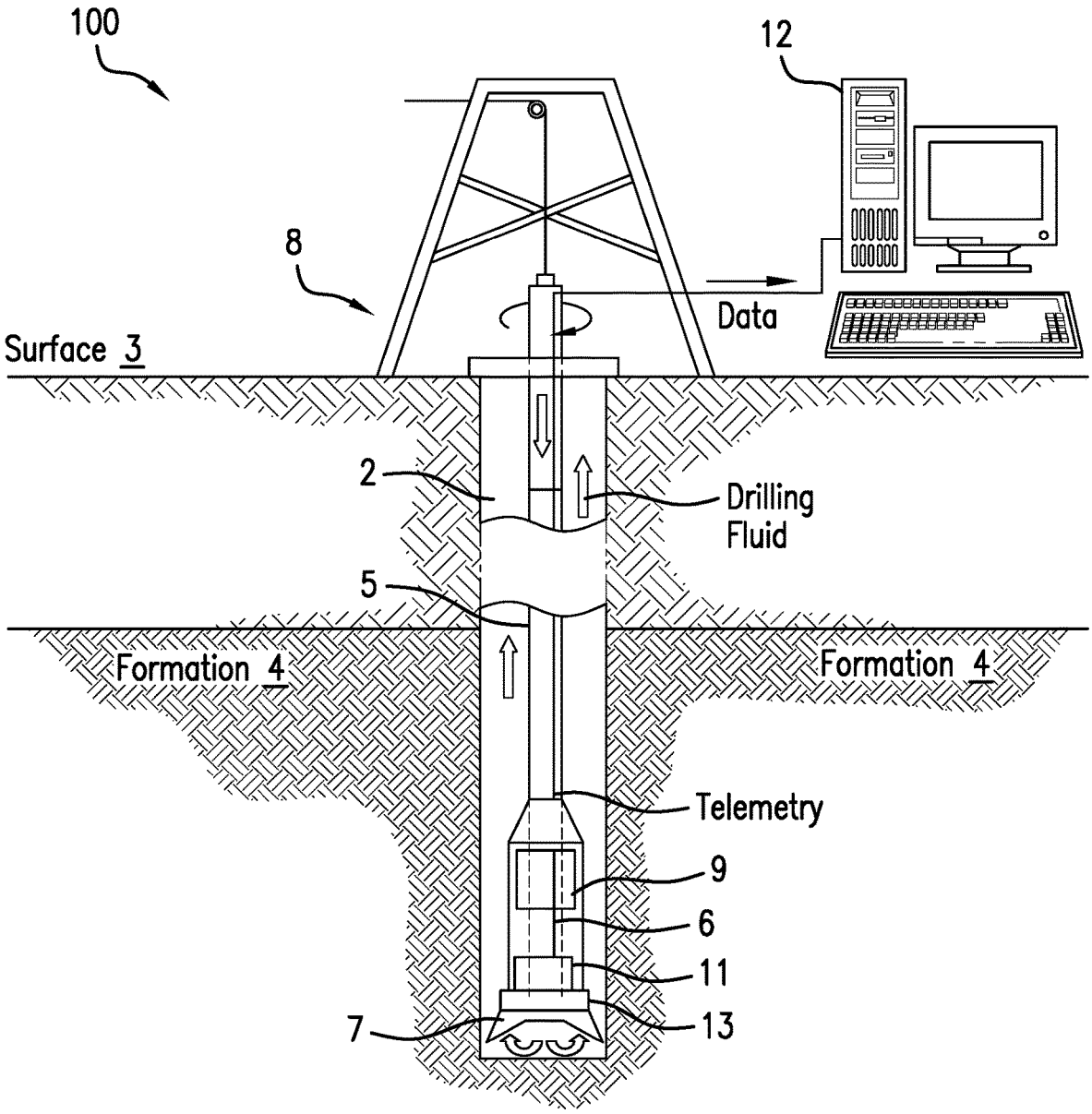
FIG. 1 depicts a cross-sectional view of a downhole system according to one or more embodiments described herein.

Wellbores are drilled into a subsurface to produce hydrocarbons and for other purposes. In particular, FIG. 1 depicts a cross-sectional view of a wellbore operation 100, according to aspects of the present disclosure. In traditional wellbore operations, logging-while-drilling (LWD) measurements are conducted during a drilling operation to determine formation rock and fluid properties of a formation 4. Those properties are then used for various purposes such as estimating reserves from saturation logs, defining completion setups etc. as described herein.

The system and arrangement shown in FIG. 1 is one example to illustrate the downhole environment. While the system can operate in any subsurface environment, FIG. 1 shows a carrier 5 disposed in a borehole 2 penetrating the formation 4. The carrier 5 is disposed in the borehole 2 at a distal end of the borehole 2, as shown in FIG. 1.

As shown in FIG. 1, the carrier 5 is a drill string that includes a bottom hole assembly (BHA) 13. The BHA 13 is apart of the drilling rig 8 that includes drill collars, stabilizers, reamers, and the like, and the drill bit 7. The BHA 13 also includes sensors (e.g., measurement tools 11) and electronic components (e.g., downhole electronic components 9). The measurements collected by the measurement tools 11 can include measurements related to drill string operation, for example. A drilling rig 8 is configured to conduct drilling operations such as rotating the drill string and, thus, the drill bit 7. The drilling rig 8 also pumps drilling fluid through the drill string in order to lubricate the drill bit 7 and flush cuttings from the borehole 2. The measurement tools 11 and downhole electronic components 9 are configured to perform one or more types of measurements in an embodiment known as logging-while-drilling (LWD) or measurement-while-drilling (MWD) according to one or more embodiments described herein.

Raw data is collected by the measurement tools 11 and transmitted to the downhole electronic components 9 for processing. The data can be transmitted between the measurement tools 11 and the downhole electronic components 9 by a powerline 6, which transmits power and data between the measurement tools 11 and the downhole electronic components 9, and/or by a wireless link (not shown) between the measurement tools 11 and the downhole electronic components 9. Power is generated downhole by a turbine-generation combination (not shown), and communication to the surface 3 (e.g., to a processing system 12) is cable-less (e.g., using mud pulse telemetry, electromagnetic telemetry, etc.) and/or cable-bound (e.g., using a cable to the processing system 12). The data processed by the downhole electronic components 9 can then be telemetered to the surface 3 for additional processing or display by the processing system 12.

Drilling control signals can be generated by the processing system 12 and conveyed downhole or can be generated within the downhole electronic components 9 or by a combination of the two according to embodiments of the present disclosure. The downhole electronic components 9 and the processing system 12 can each include one or more processors and one or more memory devices. In alternate embodiments, computing resources such as the downhole electronic components 9, sensors, and other tools can be located along the carrier 5 rather than being located in the BHA 13, for example. The borehole 2 can be vertical as shown or can be in other orientations/arrangements.

Figure 2:
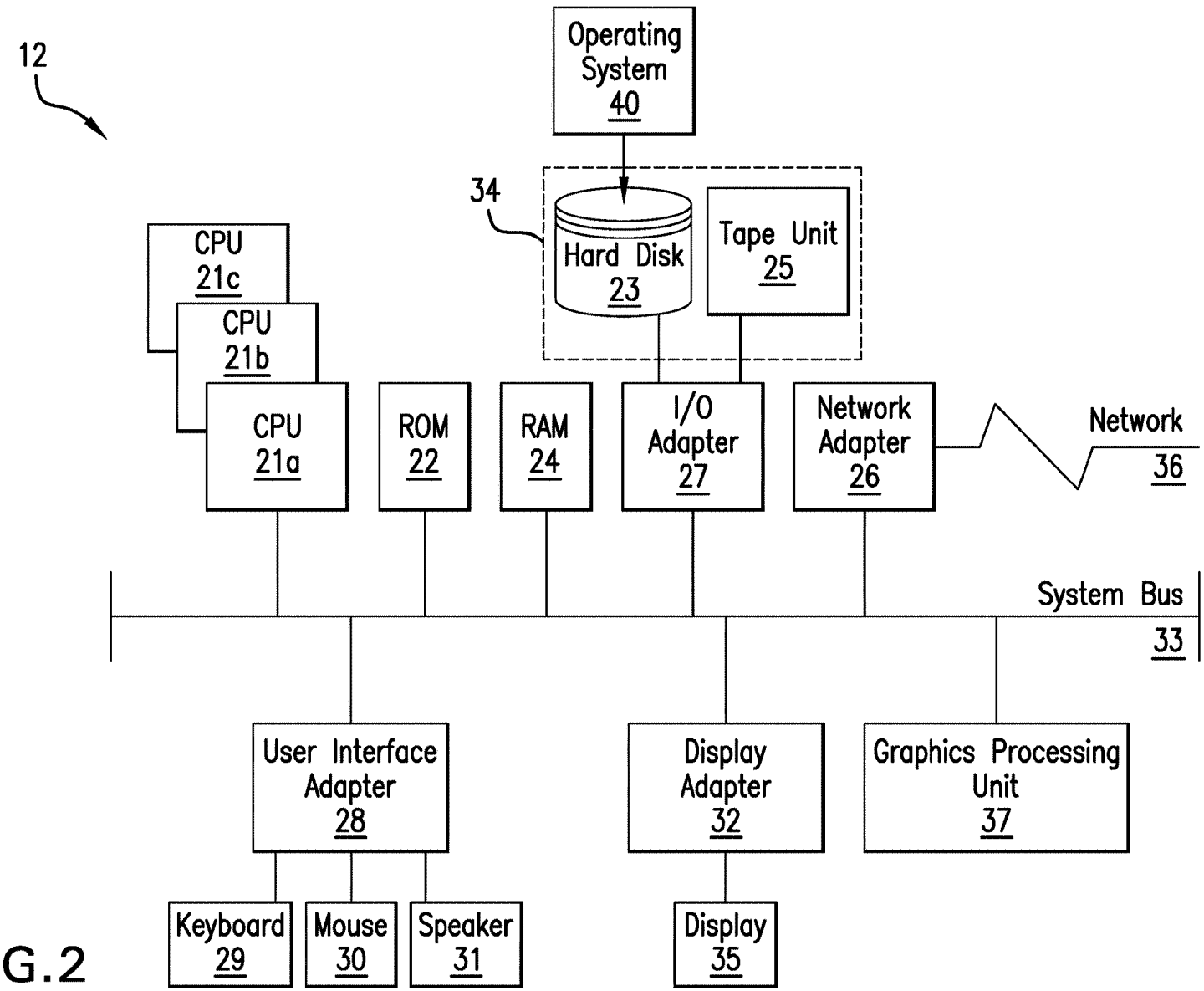
FIG. 2 depicts a block diagram of the processing system of FIG. 1, which can be used for implementing the present techniques herein according to one or more embodiments described herein.

It is understood that embodiments of the present disclosure are capable of being implemented in conjunction with any other suitable type of computing environment now known or later developed. For example, FIG. 2 depicts a block diagram of the processing system 12 of FIG. 1, which can be used for implementing the techniques described herein. In examples, processing system 12 has one or more central processing units 21*a*, 21*b*, 21*c*, etc. (collectively or generically referred to as processor(s) and/or as processing device(s)). In aspects of the present disclosure, each processor 21 can include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and can include a basic input/output system (BIOS), which controls certain basic functions of processing system 12.

Further illustrated are an input/output (I/O) adapter 27 and a network adapter 26 coupled to system bus 33. I/O adapter 27 can be a small computer system interface (SCSI) adapter that communicates with a hard disk 23 and/or a tape unit 25 or any other similar component. I/O adapter 27, hard disk 23, and tape unit 25 are collectively referred to herein as mass storage 34. Operating system 40 for execution on the processing system 12 can be stored in mass storage 34. The network adapter 26 interconnects system bus 33 with an outside network 36 enabling processing system 12 to communicate with other such systems.

A display (e.g., a display monitor) 35 is connected to system bus 33 by display adaptor 32, which can include a graphics adapter to improve the performance of graphics intensive applications and a video controller. In one aspect of the present disclosure, adapters 26, 27, and/or 32 can be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 can be interconnected to system bus 33 via user interface adapter 28, which can include, for example, a Super I/O chip integrating multiple device adapters into a single integrated circuit.

In some aspects of the present disclosure, processing system 12 includes a graphics processing unit 37. Graphics processing unit 37 is a specialized electronic circuit designed to manipulate and alter memory to accelerate the creation of images in a frame buffer intended for output to a display. In general, graphics processing unit 37 is very efficient at manipulating computer graphics and image processing and has a highly parallel structure that makes it more effective than general-purpose CPUs for algorithms where processing of large blocks of data is done in parallel.

Thus, as configured herein, processing system 12 includes processing capability in the form of processors 21, storage capability including system memory (e.g., RAM 24), and mass storage 34, input means such as keyboard 29 and mouse 30, and output capability including speaker 31 and display 35. In some aspects of the present disclosure, a portion of system memory (e.g., RAM 24) and mass storage 34 collectively store an operating system to coordinate the functions of the various components shown in processing system 12.

According to examples described herein, techniques for autonomous sampling of discrete torque and drag parameters from surface signals are performed using a classification scheme which is agnostic as to the connection procedure. Sampled values are transposed into a time-based series, which is machine monitorable. Particularly, the transposition of sampled torque and drag parameters into the time-based series is performed using real-time simulated data from physics-based models. Using the interpolated torque and drag time-based series, operating parameters of a drilling operation can be adjusted in order to mitigate effects such as stuck pipe, differential sticking, etc.

Conventional systems sample torque and drag with respect to depth by comparing the sampled data to simulated data from physics-based models produced prior to drilling (pre-well). The techniques provided herein utilize real-time and/or near-real-time physics-based modeling in combination with real-time and/or near-real-time parameter sampling as described herein to interpolate those samples and produce a friction factor for each of the discrete samples. This then is transposed into a time-based series, which can be used for monitoring the drilling operation. Alarms can be triggered during this monitoring that trigger procedures or automatic adjustment of operating parameters to mitigate potential stuck-pipe events, for example.

The sampling classification techniques described herein enable identification of downhole bit movement without physics-based engineering models. In other words, the present techniques enable bit movement detection using simple surface parameters (i.e., torque and drag parameters). Such techniques can be implemented in depleted reservoirs or particularly long extended-reach drilling sections where problems, such as differential sticking, can occur. In particular, the present techniques can be used to remedy a number of drilling dysfunctions or issues, such as unplanned wellbore tortuosity, mechanical stuck pipe (e.g., stabilizers hanging on ledges, etc.), accumulation of cuttings beds in the borehole 2, differential sticking, and the like.

Sampling of torque and drag parameters at a wellbore operation has predominantly been a purely manual task. However, accurate and timely sampling of torque and drag parameters (e.g., a pickup weight measurement, a breakover pick up weight measurement, an overpull weight measurement, a slack off weight measurement, a break over slack off weight measurement, a rotating off bottom weight measurement, a rotating off bottom torque measurement, and a break over torque measurement) requires a complex algorithmic classification that cannot practically be performed manually. For example, such classification as described herein overcomes the computational complexity and time delay problems caused by manual classification. The techniques described herein can be implemented while drilling in real-time or near-real-time to implement corrective actions to address any of the drilling dysfunctions or issues typical in energy industry operations as described herein. For example, the torque and drag parameters can be discretely identified in real-time or near-real-time while drilling based on actual surface measurements to represent friction in the wellbore. It should be understood that such techniques as described herein are not limited to drilling and can instead be used with any string in a hole (e.g., casing). To determine the torque and drag parameters, a three-step approach is applied: a) determine the features from the surface measurements, b) classify the current observation based on the features, c) quantify the torque and drag parameter for the certain classes. In examples in which deep learning is involved, the three-step approach can be reduced to a two-step approach by skipping the feature determination of step a). Based on the three-step (or two-step) approach, multiple features can be determined from the surface measurements to classify torque and drag states (e.g., pickup drag) that show characteristics particular to the states. In some examples, in addition to the required surface measurements, the system can include downhole measurements. As an example, a downhole weight on bit measurement could be included to determine when the bit lifts from bottom. To determine the features, different techniques of data processing (e.g., derivative over time, derivative over depth, average, normalization, etc.) are applied to the surface measurements. As an example relating to pickup weight measurement, this is done by looking for a plateau in the surface measurements at which point the weight "breaks over." Based on the features, the current observation is classified. The classification may be based on expert knowledge (e.g., comparing the features to thresholds defined by experts) or may be based on a trained supervised machine learning method (e.g., support vector machine, decision tree, etc.). If the current observation is one of the torque and drag classes (e.g., pick up drag, slack off drag, rotating off bottom drag, rotating off bottom torque, etc.), the system quantifies the torque and drag parameters. As an example, the quantification averages the hookload during the period the current observation is classified to be pick up drag in order to determine the torque and drag parameter "pick up weight measurement." In some examples, pipe stretch can be identified based on real-time/near-real-time surface measures by measuring block displacement required for a "break-over" instead of using modeling, which is the conventional approach and is error-prone. The pipe stretch identified for pick up drag and slack off drag can be used to provide the driller an indication on how far to move the block in order to get a reliable pick up weight measurement and slack off weight measurement. In another example, these pipe stretch values can be fed into an automated drilling system as set points for a friction test to determine torque and drag parameters.

One example approach to autonomous torque and drag monitoring is as follows. Torque and drag parameters for an upstream well construction operation are simulated using physics-based modeling. Measured (actual) torque and drag parameters are then acquired during performing the drilling or other operations with a string in the hole. Friction factors are interpolated at different sampling times for the measured torque and drag parameters. These interpolated friction factors are transposed into a time-based series for the different sampling times for the measured torque and drag parameters. Using the interpolated friction factors, a corrective action can be performed when it is determined that one or more of the friction factors at a particular point in time deviates from its expected behaviors. This deviation from its expected behavior is called an anomaly. According to examples, an anomaly can be detected by a comparison with previously defined thresholds, trend changes, changepoint detection algorithms, or anomaly detection algorithms. The parameters (e.g., the threshold to compare with) for all of these algorithms could be determined by physics-based models for the specific well or could be based on data-driven models based on previous wells.

Figure 3:
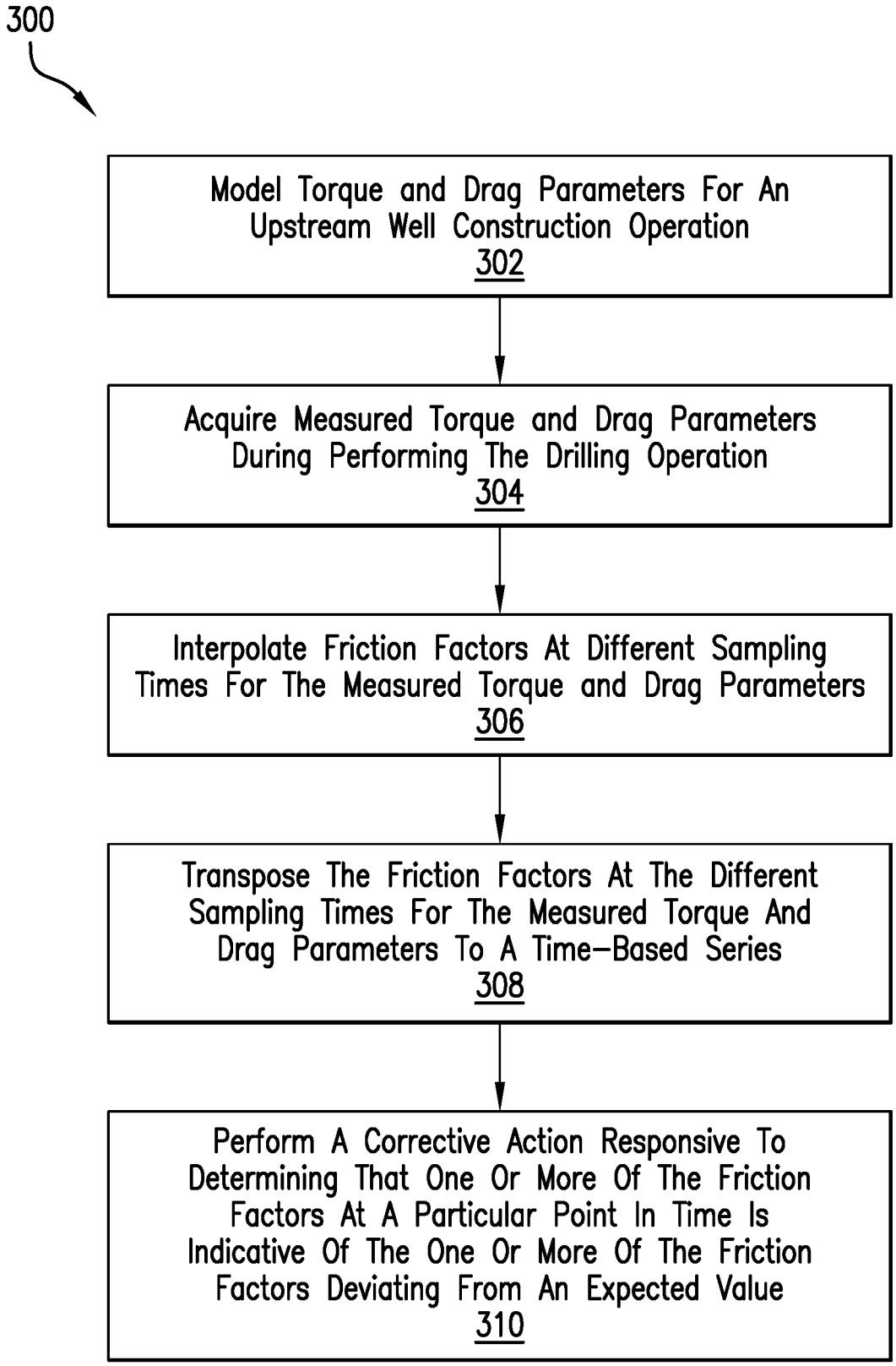
FIG. 3 depicts a flow diagram of a method for performing autonomous torque and drag monitoring according to one or more embodiments described herein.

FIG. 3 depicts a flow diagram of a method 300 for performing autonomous four-dimensional torque and drag monitoring according to one or more embodiments described herein. The method 300 can be performed by any suitable processing system (e.g., the processing system 12), any suitable processing device (e.g., one of the processors 21), and/or combinations thereof or the like. The method 300 can be performed during upstream well construction operations, which can include exploration and production activities, such as a drilling operation.

At block 302, the processing system 12 models torque and drag parameters for an upstream well construction operation (e.g., a drilling operation). Examples of the discrete torque and drag parameters include pickup weight measurement, pickup breakover weight measurement, overpull weight measurement, slack off weight measurement, slack off break over weight measurement, rotating off bottom weight measurement, rotating off bottom torque measurement, and break over torque measurement. Other discrete torque and drag parameters may also be used. Modeling the torque and drag parameters can include generating expected (modeled) curves for the torque and drag parameters (see, e.g., FIG. 5A).

At block 304, the processing system 12 acquires measured torque and drag parameters during performing the upstream well construction operation. For example, as the BHA 13 moves along the borehole 2, the raw data is collected, for example by the measurement tools 11, and transmitted to the surface 3 or a measurement device at the surface for additional processing or display by the processing system 12.

Figure 6:
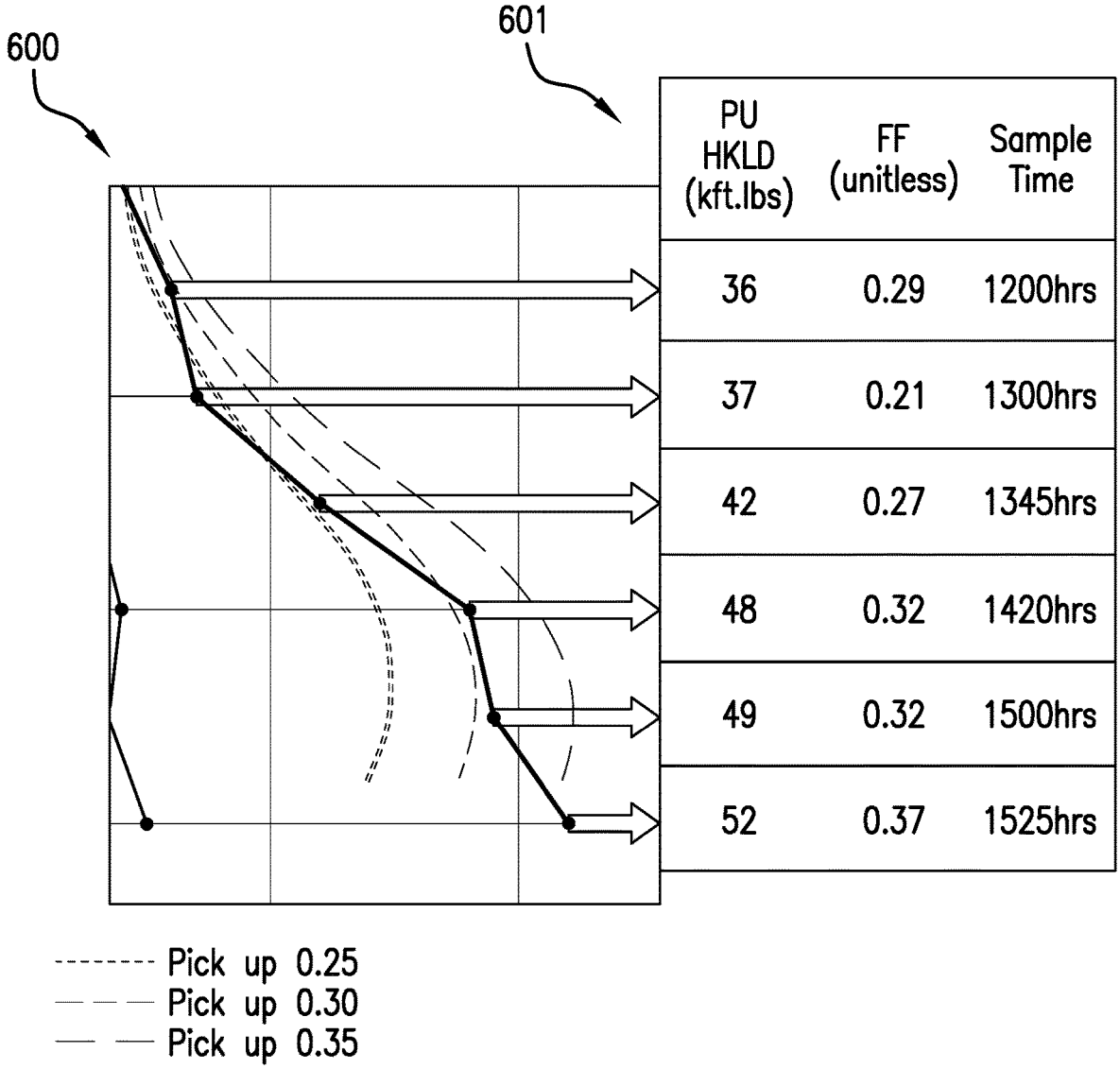
FIG. 6 depicts the interpolation of friction factors at different sampling times for the measured torque and drag parameters according to one or more embodiments described herein.

At block 306, the processing system 12 interpolates friction factors at different sampling times for the measured torque and drag parameters. As described in more detail with reference to FIG. 6, the friction factors are interpolated between expected (modeled) curves generated during the modeling (block 302) and the measured torque and drag parameters that are sampled while performing the upstream well construction operation (block 304). For example, by comparing the measured torque and drag parameters to the expected (modeled) curves, as shown in FIG. 6, friction factors are interpolated.

Figure 7:
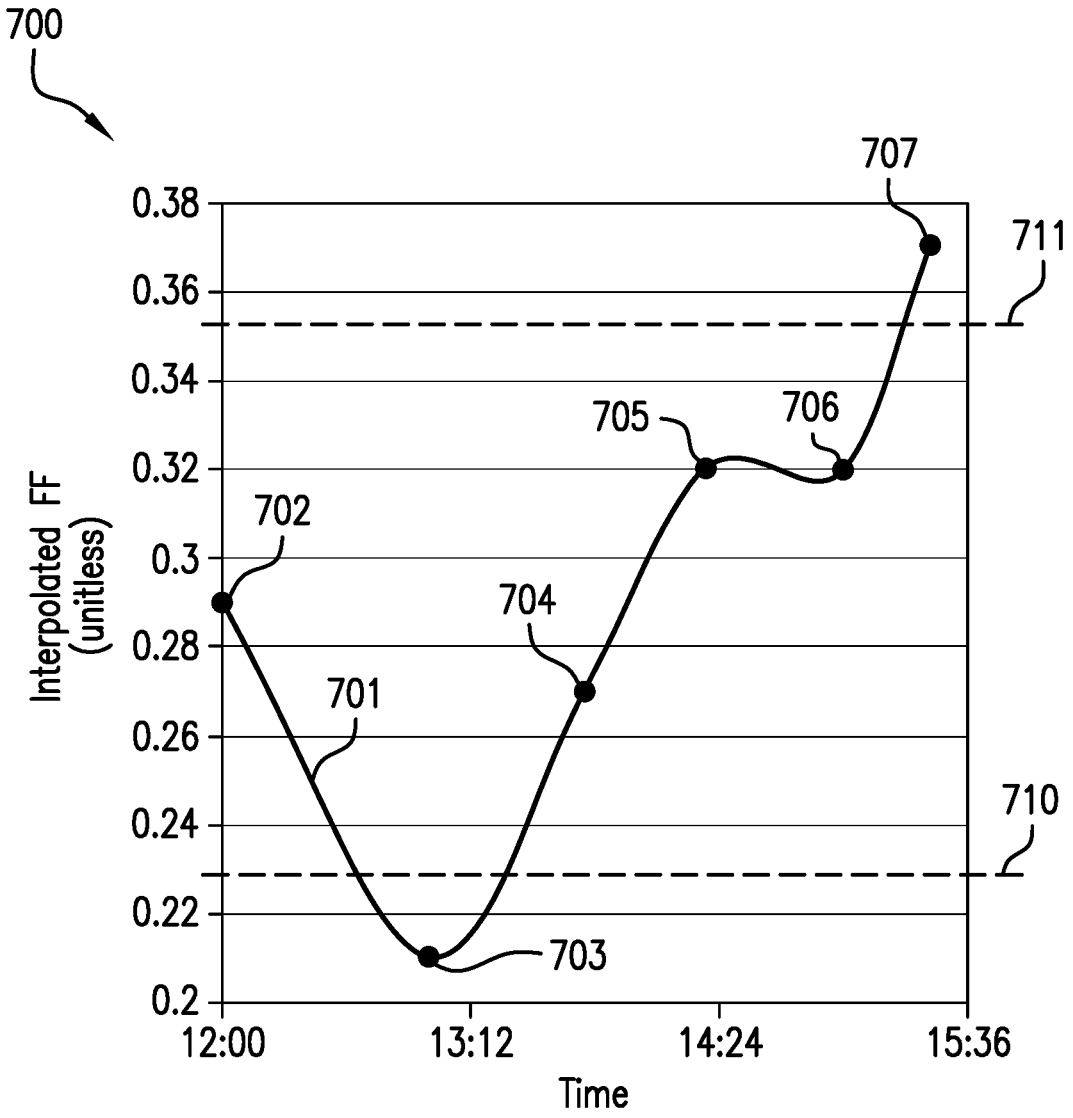
FIG. 7 depicts a graph of a time-based series of the friction factors interpolated in FIG. 6 according to one or more embodiments described herein.
Figure 8A:
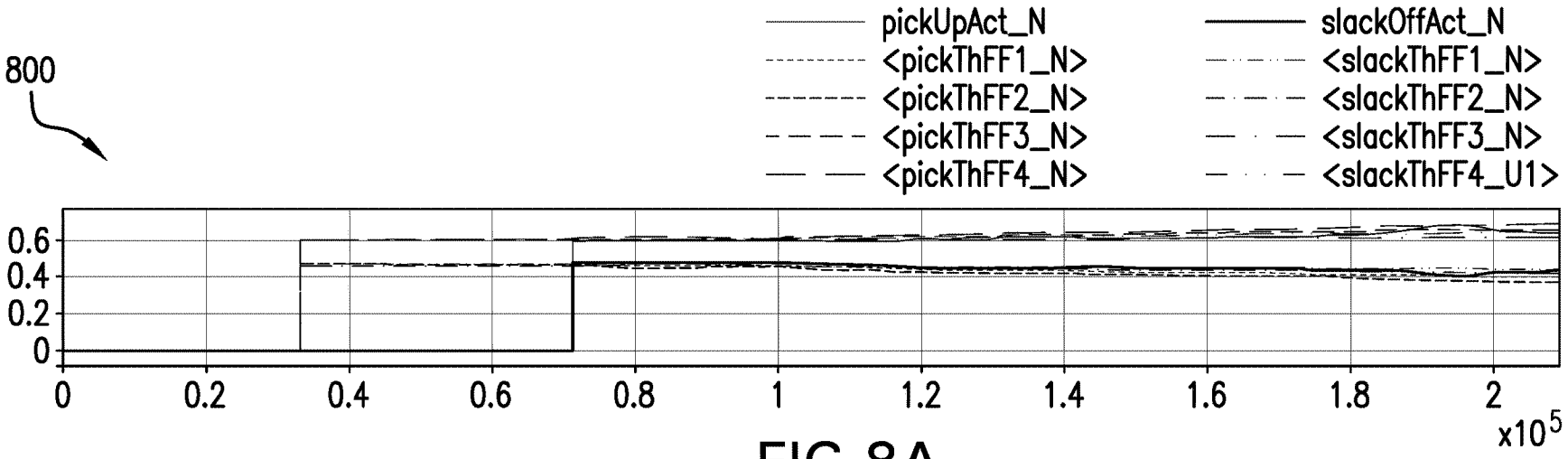
FIGS. 8A, 8B, 8C, and 8D depict various graphs of torque and/or drag data and/or friction forces of according to one or more embodiments described herein.
Figure 8B:
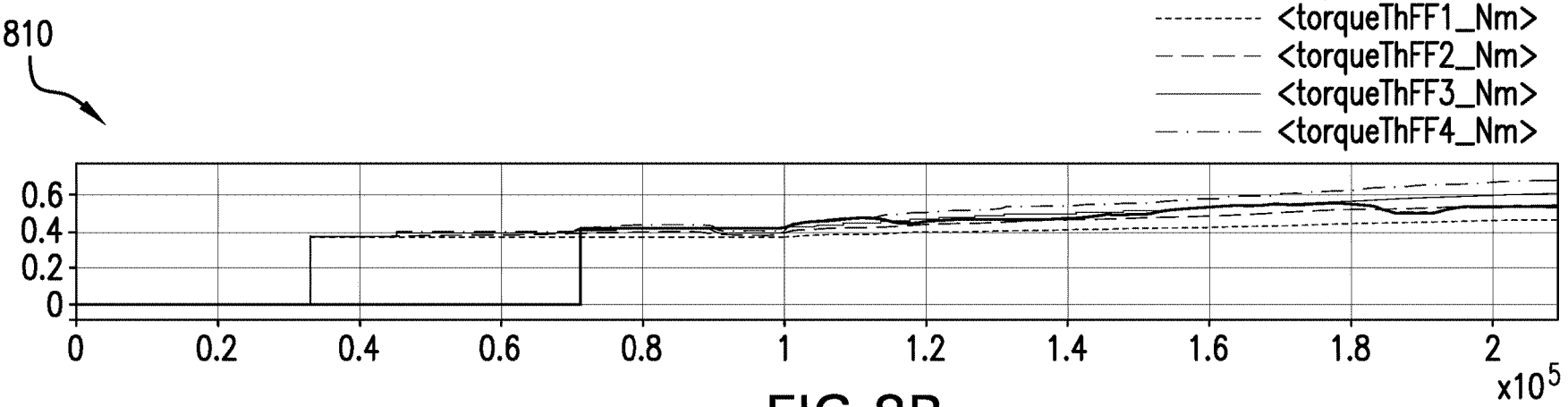
Figure 8C:
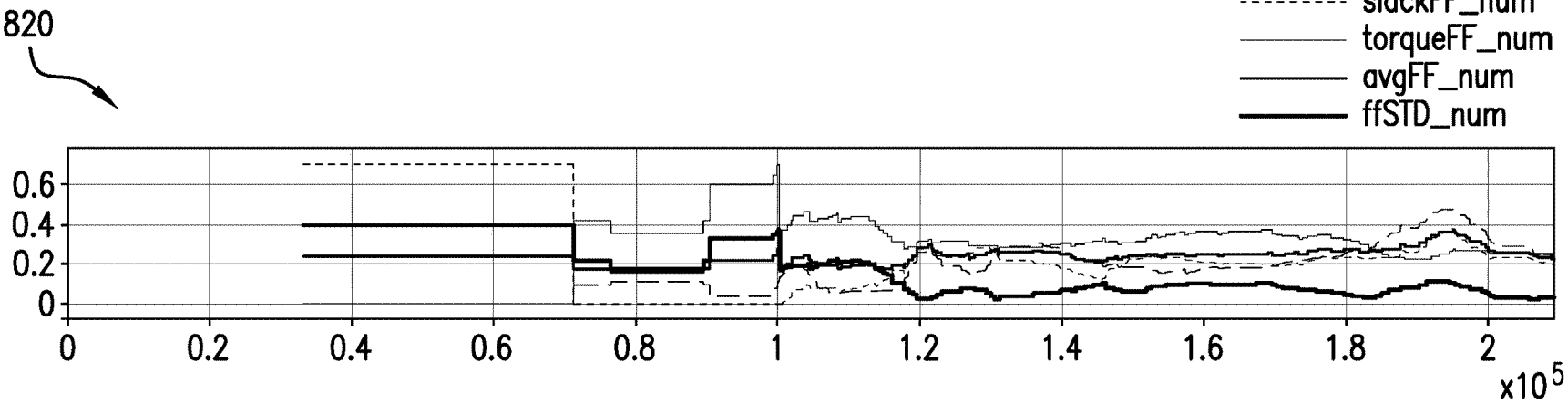
Figure 8D:
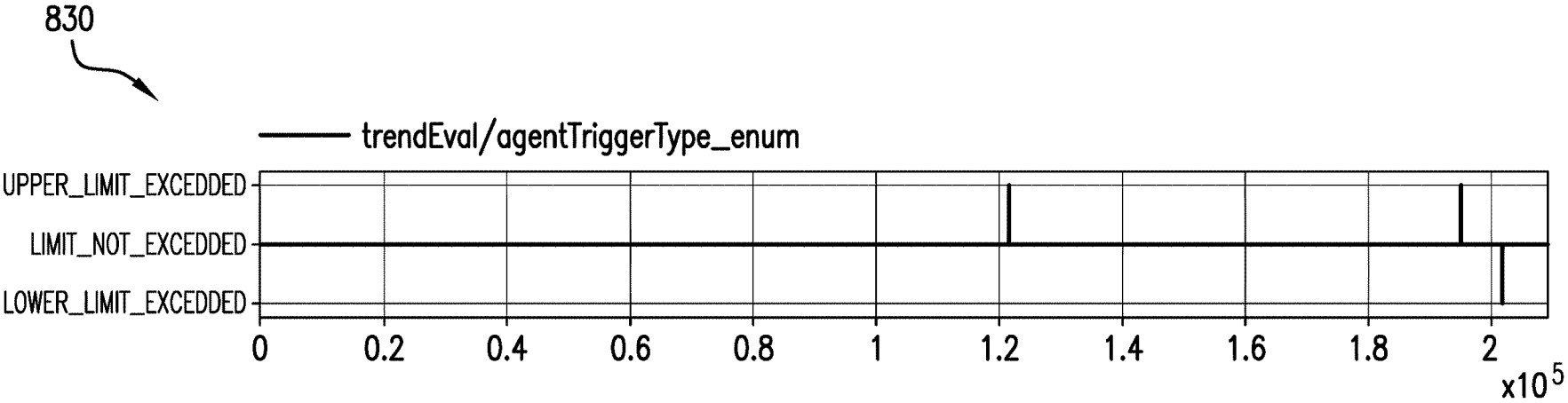

At block 308, the processing system 12 transposes the friction factors at the different sampling times for the measured torque and drag parameters to a time-based series. An example of such a time-based series is depicted in FIG. 7 and further described herein. Transposing the friction factors to the time-based series normalizes the friction factors using, for example, theoretical hookload data/curves for the various friction factors.

At block 310, the processing system 12 performs a corrective action responsive to determine that one or more of the friction factors at a particular point in time is indicative of the one or more of the friction factors deviating from their expected values. One example of this deviation is that one or more of the friction factors falls outside of a range bounded by a lower limit threshold and an upper limit threshold. As shown in FIG. 7, a lower limit threshold 710 and an upper limit threshold 711 can be set, for example, based on predicted drilling dysfunctions. When it is determined that one or more of the friction factors at a particular point in time is indicative of the one or more of the friction factors deviating from their expected value (e.g., falling outside of the range bounded by the thresholds 710, 711, show a trend change or any other behavior covered by anomaly detection), a corrective action can be performed. Examples of corrective actions include alerting an operator/technician, adjusting a drilling trajectory, adjusting a weight on a drill bit, adjusting a rotation rate of the drill bit, and the like, including combinations thereof.

Additional processes also may be included, and it should be understood that the process depicted in FIG. 3 represents an illustration, and that other processes may be added or existing processes may be removed, modified, or rearranged without departing from the scope of the present disclosure.

As an example of such an additional process, the method 300 can include identifying pipe stretch based on the real-time/near-real-time surface measures (i.e., the measured torque and drag parameters) by measuring block displacement required for a "break-over" instead of using modeling, which is the conventional approach and is error-prone. In examples, the identified pipe stretch can be fed back as a set point into an automated friction test system (or to a driller/operator) to ensure regular torque and drag measurement updates.

The features and functionality of the method 300 is now described in more detail with respect to FIGS. 4, 5A, 5B, 6, and 7.

Figure 4:
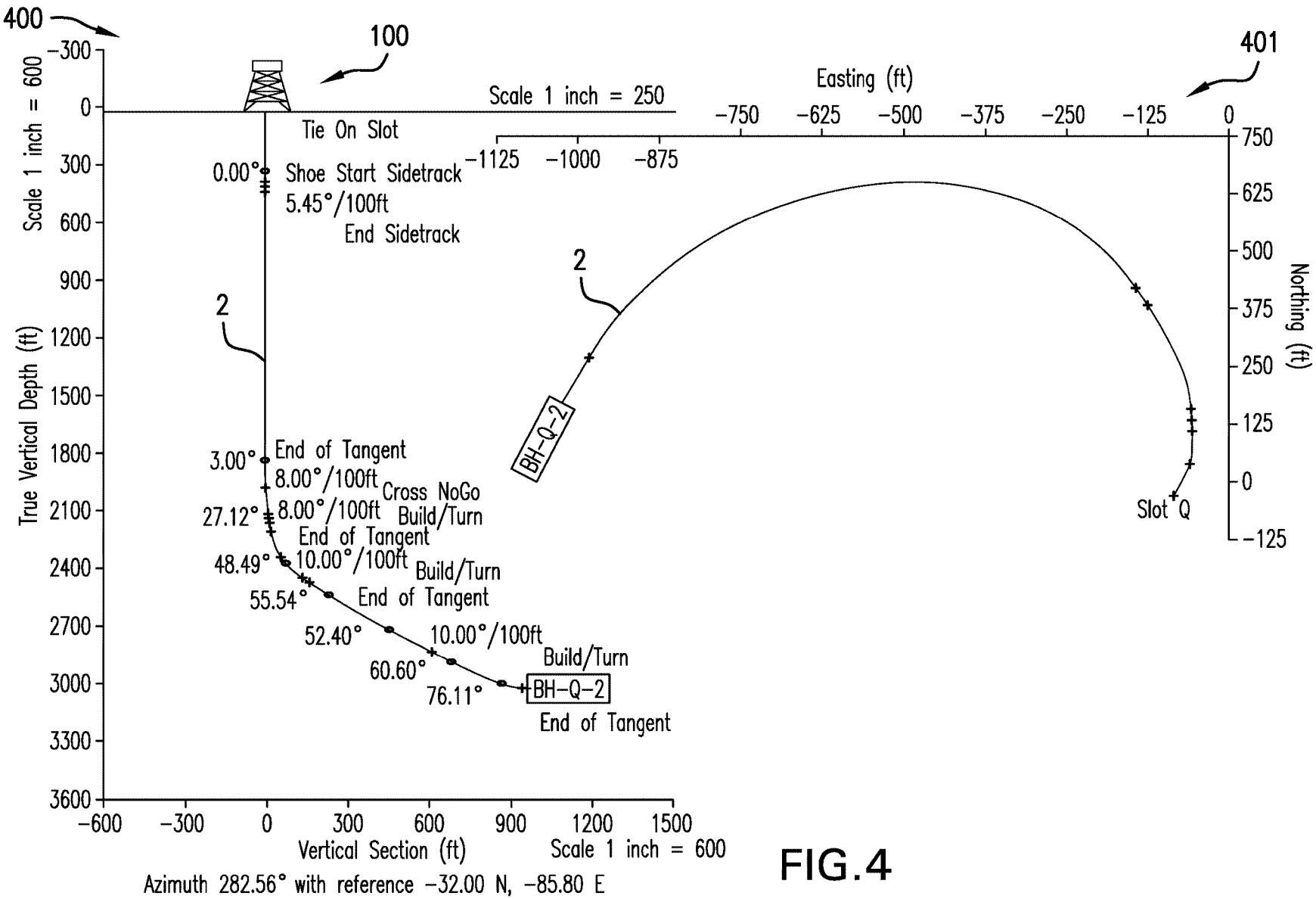
FIG. 4 depicts plots of the borehole of the wellbore operation of FIG. 1 according to one or more embodiments described herein.

FIG. 4 depicts plots 400, 401 of the borehole 2 of the wellbore operation 100 of FIG. 1 according to one or more embodiments described herein. In particular, the plot 400 shows a true vertical depth (feet) plotted against a vertical section (feet) for the borehole 2, and the plot 401 shows easting (feet) versus northing (feet) for the borehole 2.

Figure 5A:
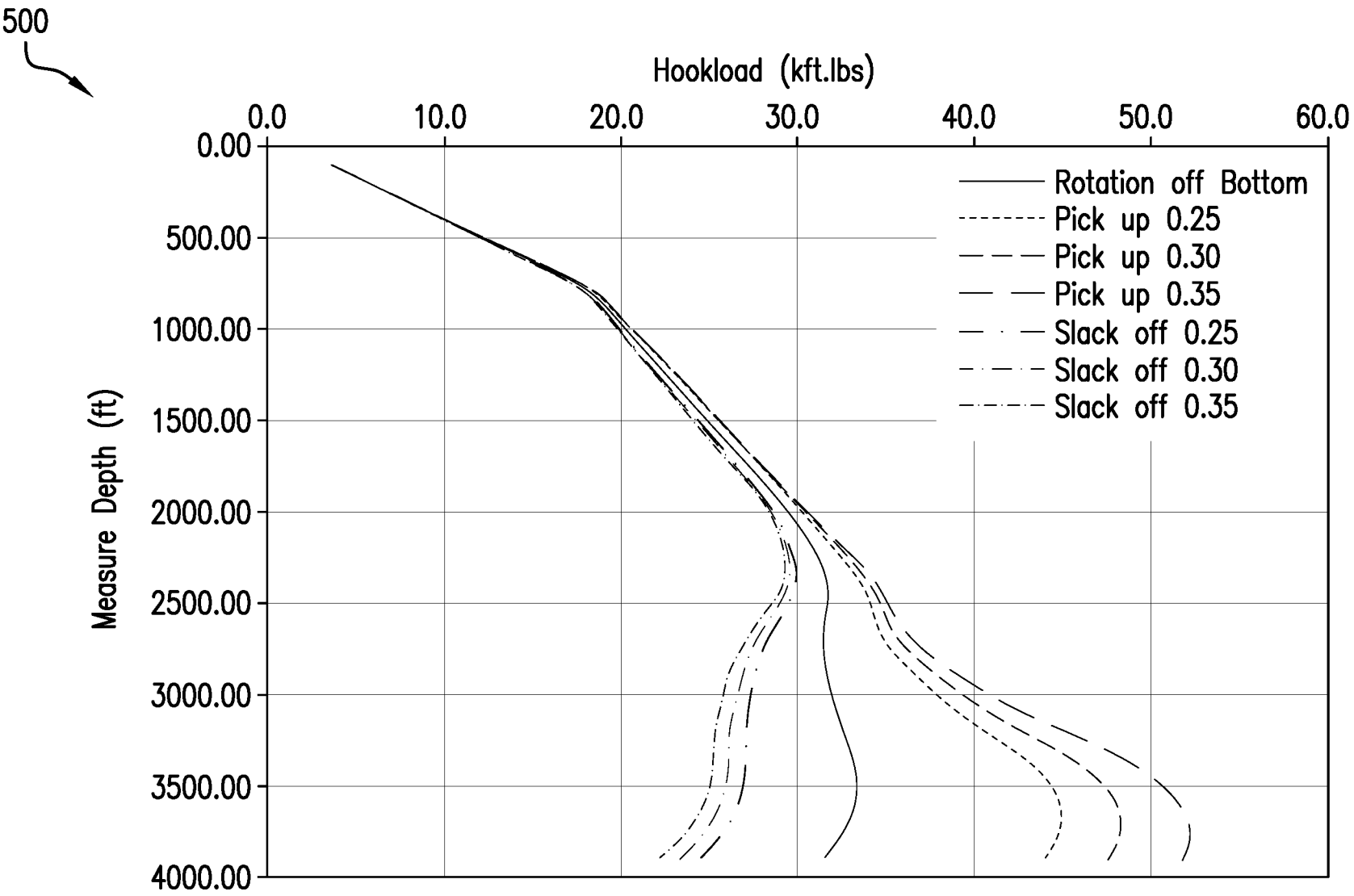
FIG. 5A depicts a plot of expected (modeled) hookload versus depth for various friction factors according to one or more embodiments described herein.

Prior to drilling the borehole 2, torque and drag values can be modeled for different depths along the projected path of the borehole 2. In particular, the modeled values for indicated (i.e., what is seen at the surface 3) hookloads for torque and drag, using different friction factors for the openhole section, take into account the wellbore geometry (both diameters and trajectory) as well as basic physics pertaining to the buoyancy of the drill string within the drilling fluid. An example plot 500 is shown in FIG. 5A, which plots expected (modeled) hookload (kilo foot pounds) versus depth (feet) for various torque and drag parameters. Examples of such torque and drag parameters as shown in FIG. 5A (and also FIG. 5B) are pickup 0.25 (friction factor), slack off 0.25 (friction factor), pickup 0.30 (friction factor), slack off 0.30 (friction factor), pickup 0.35 (friction factor), slack off 0.35 (friction factor), and rotation off bottom.

Figure 5B:
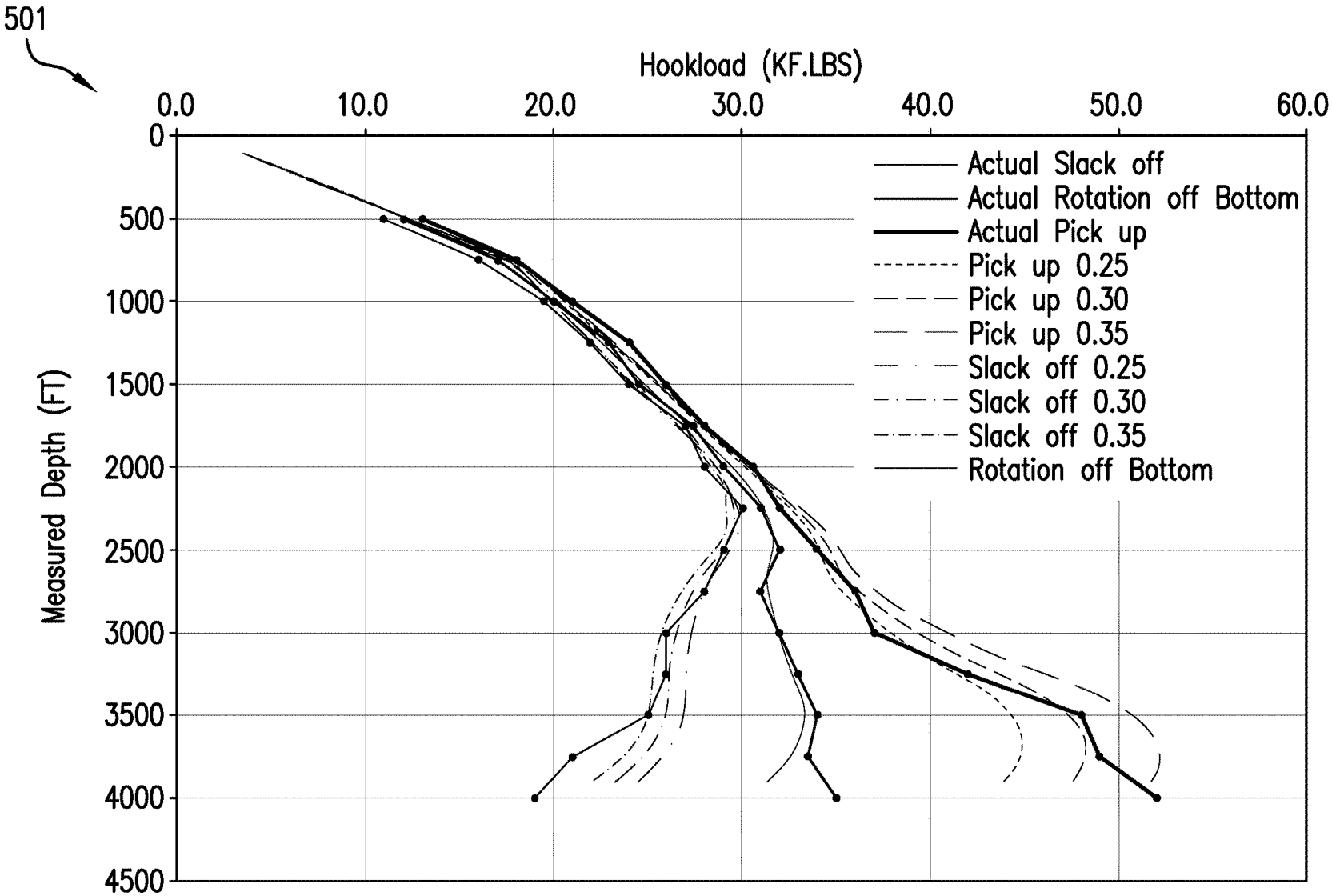
FIG. 5B depicts a plot of actual (measured) hookload versus depth for various friction factors according to one or more embodiments described herein.

As the BHA 13 moves along the borehole 2, the raw data is collected, for example by one or more of the measurement tools 11 (also referred to as a "measurement device"), and transmitted to the surface 3 for additional processing or display by the processing system 12. In some examples, the raw data can be collected by one or more measurement devices at the surface. Also, a combination of raw data collected by one or more of the measurement tools 11 and raw data collected by one or measurement devices at surface are possible. FIG. 5B depicts an example plot 501, which plots actual (measured) hookload (kilo foot pounds) versus depth (feet) for actual slack off, actual rotation off bottom, and actual pickup, superimposed with the expected (modeled) hookload of FIG. 5A.

Actual (measured) values for torque and drag parameters, which can be sampled automatically, have historically been plotted or overlaid on top of the expected (modeled) theoretical curves to give drillers an indication of what modeled torque and drag parameters are most representative of the current downhole conditions as shown in FIG. 5B. Deviations from one of these modeled curves suggest that friction is changing, either increasing or decreasing, in the openhole section of the borehole 2. This could be a symptom of a number of drilling dysfunctions or issues, such as unplanned wellbore tortuosity, mechanical stuck pipe (e.g., stabilizers hanging on ledges, etc.), accumulation of cuttings beds in the borehole 2, differential sticking, and the like. Depending on which of the child parameters (pickup, slack off, rotating off bottom, breakover, etc.) are changing, and the character of the change, this enables root causes to be identified. That is, the root cause of the increase/decreasing in friction in the wellbore can be identified. Once the root cause is identified, it can be mitigated and/or remediated.

FIG. 6 depicts the interpolation of friction factors at different sampling times for the measured torque and drag parameters according to one or more embodiments described herein. In particular, FIG. 6 depicts a portion 600 of a plot (e.g., the plot 501 of FIG. 5B), which plots actual (measured) hookload versus depth for actual torque and drag parameters as described herein. FIG. 6 also depicts a table 601 of interpolated friction factors that correspond to different sampled times for the pickup hookload values of the portion 600 of the plot. In this example, the table 601 includes pickup (PU) hookloads (hkld) in kilo foot pounds, unit less friction forces, and sampling times. For example, at sampling time 1200 hours, a pickup hookload is measured to be 36, and the friction force is interpolated to be 0.29. This friction force (0.29) is determined by comparing the measured hookload at a particular sample time (i.e., 1200 hrs) to the expected (modeled) friction force curves as shown in FIGS. 5A, 5B, and 6. As can be observed in FIG. 6, the measured hookload value at the sample time 1200 hrs is slightly less (to the left) of the 0.30 friction force expected (model) at this time. Therefore, the friction force is interpolated to be 0.29.

As another example, at sampling time 1300 hours, a pickup hookload is measured to be 37, and the friction force is interpolated to be 0.21. Thus, FIG. 6 shows interpolating between the theoretical curves (e.g., of FIG. 5A) and assigning a friction factor to each sample taken. These depth-based samples for measured torque and drag parameters are transposed, in the context of the modeled data, into a simple time-based series that in-experienced humans, and more importantly simple algorithmic detection agents (trend detection), can operate on.

FIG. 7 depicts a graph 700 of a time-based series of the friction factors interpolated in FIG. 6 according to one or more embodiments described herein. The graph 700 depicts the friction factors interpolated in FIG. 6 as unit less values plotted versus sample time (that is, the time the torque and drag parameters were measured). A line 701 formed of points 702, 703, 704, 705, 706, 707 is formed as shown. As described herein, the friction factors at the different sampling times for the measured torque and drag parameters are transposed to a time-based series depicted by the graph 700. As a result, along the time of the sample, a time-based series is provided that represents friction in the wellbore, independent of on/off bottom movement, rate of penetration, or tripping operation.

In some examples, as depicted in FIG. 7, a range is bounded by a lower limit threshold 710 and an upper limit threshold 711. If any of the points 702-707 fall outside the range bounded by the thresholds 710, 711, it may be indicative that a friction factor associated with the point falling outside the range is problematic (i.e., not exhibiting an expected behavior). Thus, the thresholds 710, 711 can be set based on an expected behavior such that any points falling outside the range defined by the lower limit threshold and the upper limit threshold is a symptom of a dysfunction of the upstream well construction operation (e.g., stuck pipe). In the example shown in FIG. 7, the points 703 and 707 fall outside the range bounded by the thresholds 710, 711, while the points 702 and 704-706 fall within the range. Points falling outside the range bounded by the thresholds 710, 711 could be a symptom of a number of drilling dysfunctions or issues, such as un-planned wellbore tortuosity, mechanical stuck pipe (e.g., stabilizers hanging on ledges, etc.), accumulation of cuttings beds in the borehole 2, differential sticking, and the like. Other symptoms could be trend changes of the points, or any other deviation from their expected value. It may be desirable to implement a corrective action to mitigate the dysfunction.

FIGS. 8A, 8B, 8C, and 8D depict various graphs 800, 810, 820, 830 of torque and/or drag data and/or friction forces of according to one or more embodiments described herein. The graph 800 plots pickup (i.e., pickUpAct_N, pickThFF1_N, pickThFF2_N, pickThFF3_N, pickThFF4_N) and slackoff (i.e., slackOffAct_N, slackThFF1_N, slackThFF2_N, slackThFF3_N, slackThFF4_U1) measurements. The graph 810 plots torque measurements (i.e., torqueAct_Nm, torqueThFF1_N, torqueThFF2_N, torqueThFF3_N, torqueThFF4_N). The graph 820 plots friction forces including a pickup friction force (i.e., pickFF_num), a slackoff friction force (i.e., slackFF_num), a torque friction force (i.e., torqueFF_num), average friction force (i.e., avgFF_num), and friction force standard deviation e(i.e., ffSTD_num). The graph 830 plots the upper limit threshold and lower limit threshold as being exceeded or not exceeded.

Figure 9:
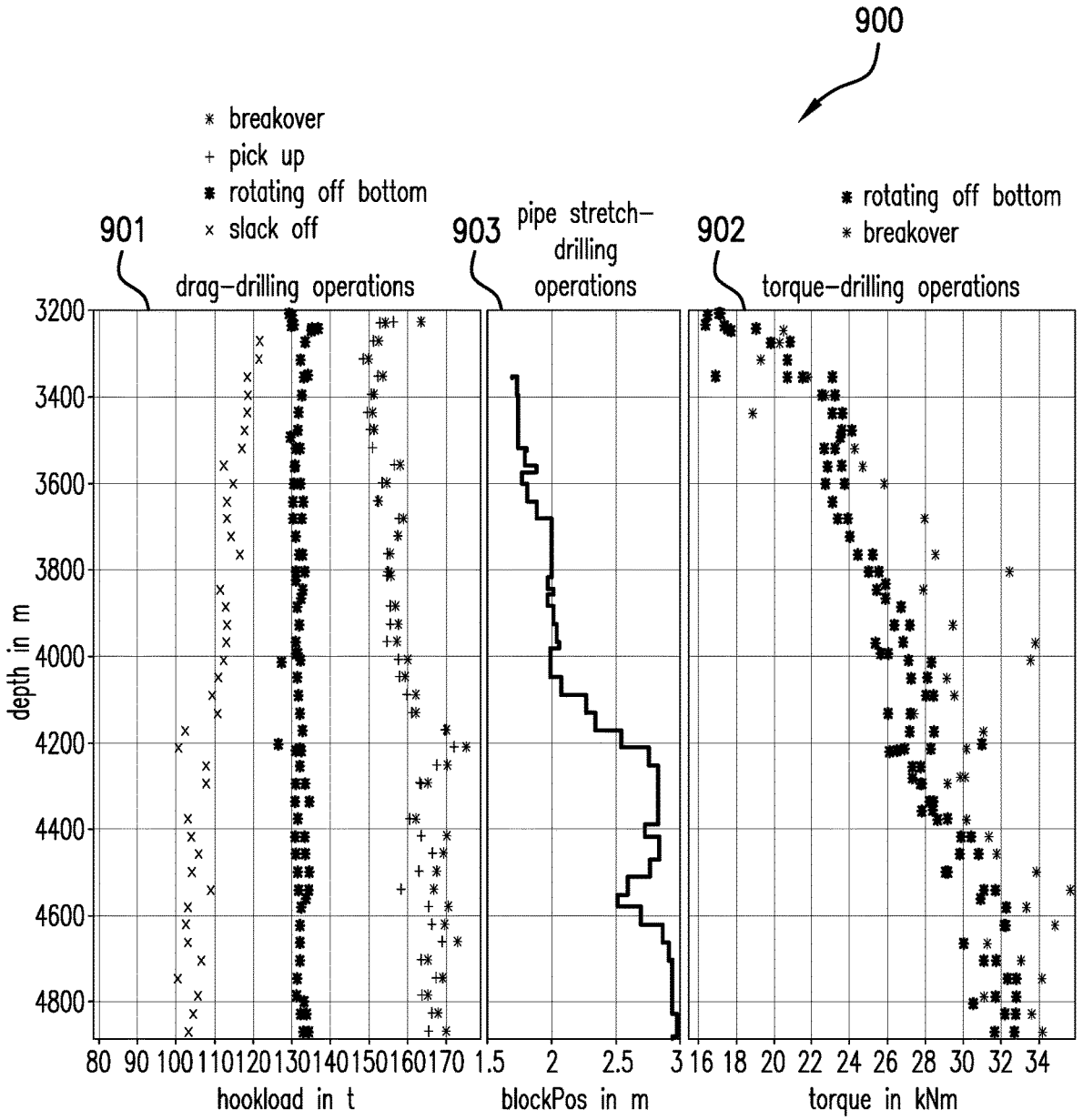
FIG. 9 depicts a graph of torque and drag measurements over bit depth is depicted according to one or more embodiments described herein.

Turning now to FIG. 9, a graph 900 of torque and drag measurements over bit depth is depicted according to one or more embodiments described herein. In particular, the graph 900 includes sub-plots for drag measurements 901, torque measurements 902, and pipe stretch 903. As described herein, of the discrete torque and drag parameters include pickup weight measurement (drag), breakover weight measurement (drag), overpull weight measurement (drag), slack off weight measurement (drag), rotating off bottom weight measurement (drag), rotating off bottom torque measurement (torque), and break over torque measurement (torque). According to one or more embodiments described herein, for each measurement, the bit depth and an update flag is assigned (except break over weight/load, which is combined with pick up weight/load). Additionally, the block movement (pipe stretch) for getting a reliable pick up weight/load and slack off weight/load measurement is output. According to one or more embodiments described herein, each measurement/observation can be classified to be a certain drag class (e.g., pick up, slack off, rotating off bottom, overpull, or undefined) and a certain torque class (e.g., rotating off bottom, break over or undefined).

Examples for pickup weight measurement, break over weight measurement, overpull weight measurement, slack off weight measurement, rotating off bottom weight measurement, rotating off bottom torque measurement, and break over torque measurement are now described.

Figure 10:
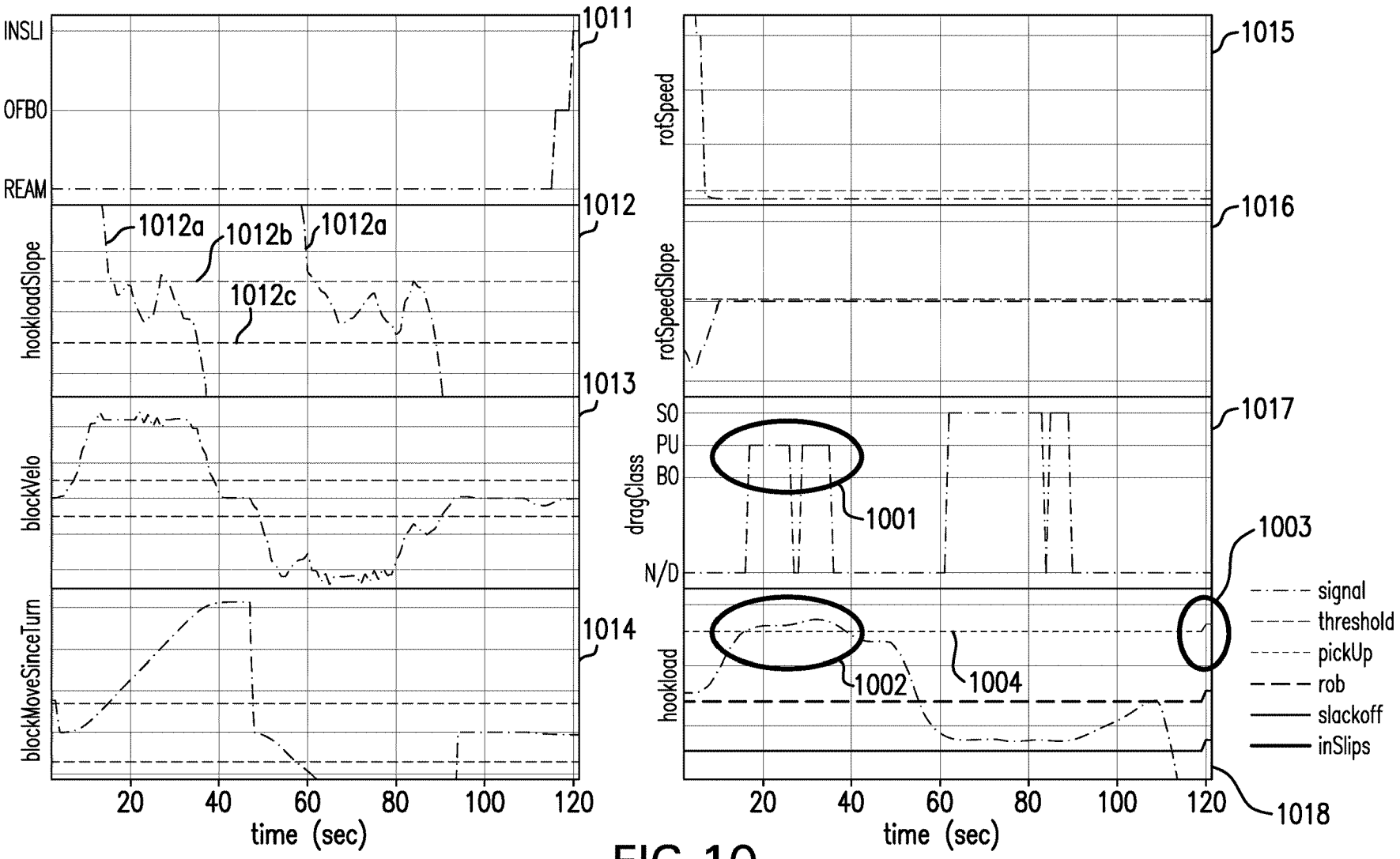
FIG. 10 depicts an example of a pickup measurement according to one or more embodiments described herein.

The pickup weight is the weight measured when the whole drillstring is moved up without rotation. In this case, the static friction is overcome and a steady dynamic friction is counteracting the block up movement. The drillstring is stretched with the neutral point at the bottom of the bit and ideally, the stretch is steady. FIG. 10 depicts examples of graphs of pickup measurements according to one or more embodiments described herein. In particular, FIG. 10 depicts an example of a satisfactory pickup measurement according to one or more embodiments described herein. The diagrams 1011, 1012, 1013, 1014, 1015, and 1016 show the processed features (e.g., processed features 1012*a* of diagram 1012) and their thresholds (e.g., thresholds 1012*b*, 1012*c* of diagram 1012), which are used to classify an observation. The shown classification technique refers to a decision tree classification. Other methods like support vector machines (SVMs) are also possible. The diagram 1017 shows the classification output (BO: break over, PU: pick up, SO: slack off, N/D: not defined). The diagram 1018 shows the hookload for this period. This approach also applies similarly to the examples shown in and described regarding FIGS. 11-15.

In the example of FIG. 10, a pickup 1001 is detected between the 10 second and 40 second marks (approx.) on the drag class plot (i.e., diagram 1017). During this period the features of the diagrams 1011-1016 meet the conditions of the decision tree with respect to their thresholds (within the thresholds for 1012, above the threshold in 1013, above the threshold in 1014, below the threshold in 1015 and below the threshold in 1016). On the hookload plot (i.e., diagram 1018), the pickup is averaged 1002 and updated 1003, after the quantification (here averaging) is finished. In this example, the hookload is averaged when the drag class (i.e., diagram 1017) is equal to a pickup value 1004, and the pickup value 1004, is updated 1003.

Break over weight/load is measured in combination with pickup weight/load. The break over weight measurement takes the highest hookload value at the beginning of a pickup measurement as the break over weight/load.

Figure 11:
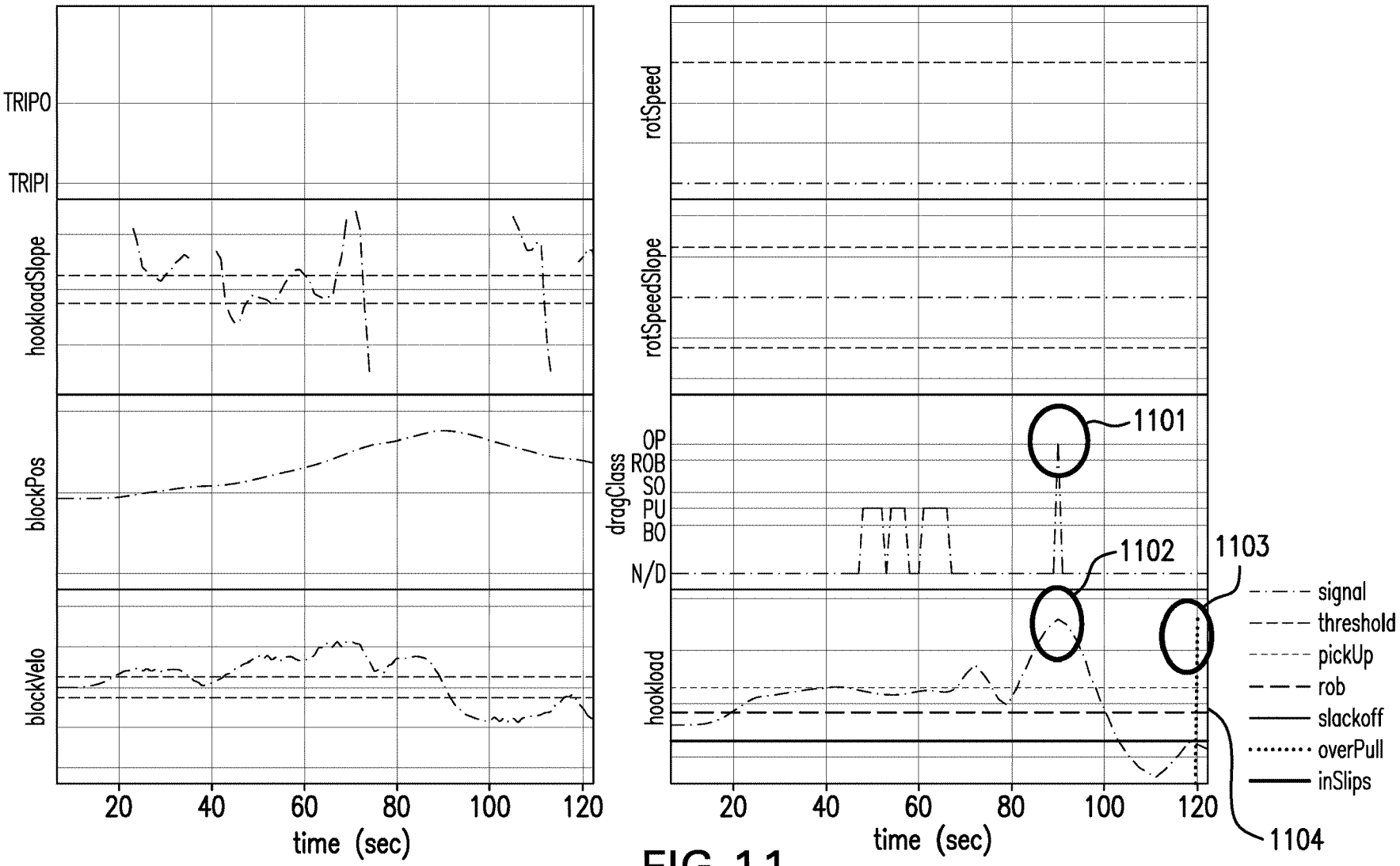
FIG. 11 depicts an example of an over pull measurement after picking up the drillstring during trip out according to one or more embodiments described herein.

Over pull weight/load is any weight that is greater than the current pickup weight but is not detected as a pickup measurement (i.e., a flat hookload slope during block up movement). Over pull weights are measured for example at stuck pipe incidents. FIG. 11 depicts an example of an over pull measurement after picking up the drillstring during trip out according to one or more embodiments described herein. In this example, overpull 1101 is detected, and an over pull max value 1102 is identified. The over pull value 1104 is then updated 1103.

Figure 12:
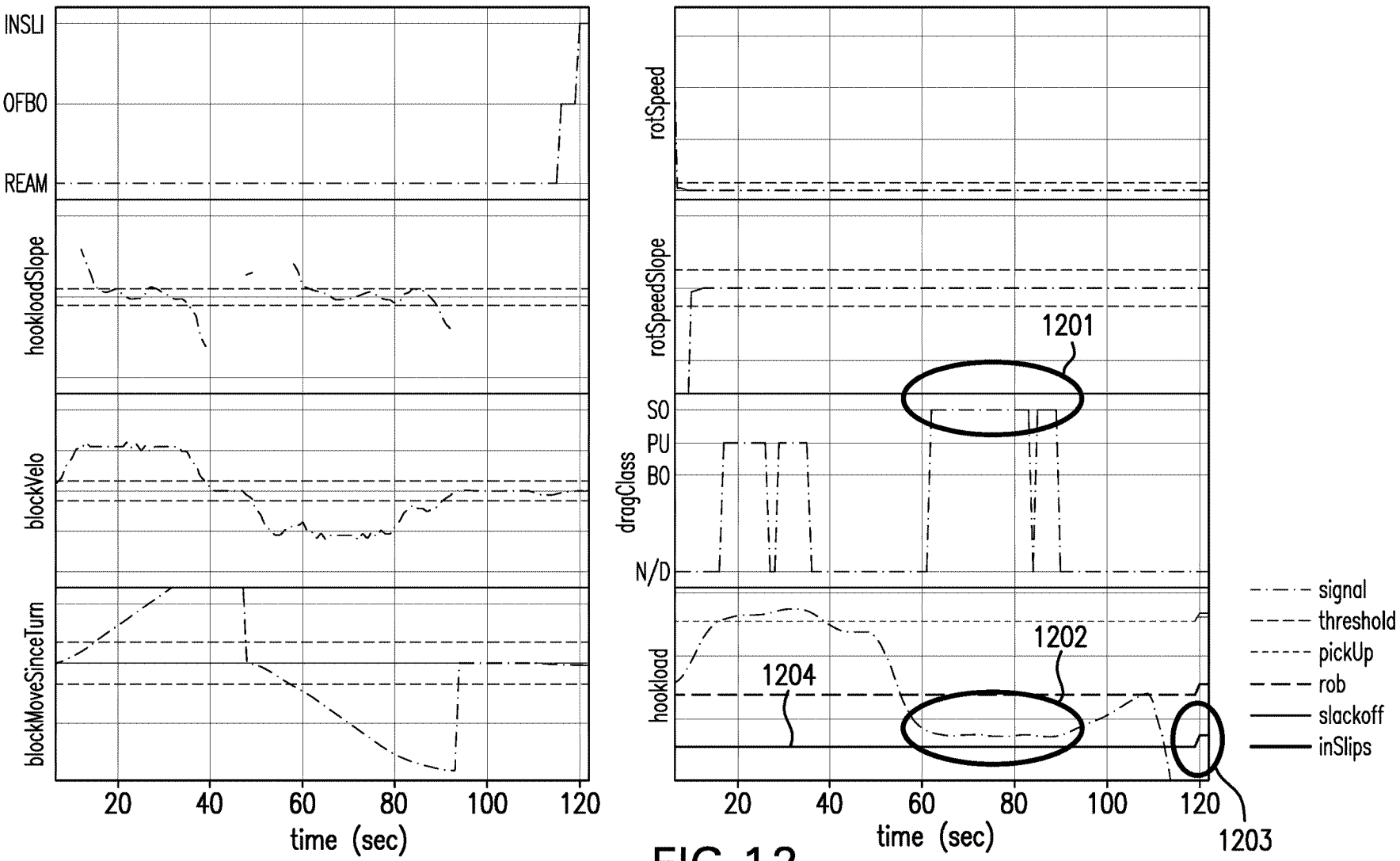
FIG. 12 depicts an example of a slack off measurement according to one or more embodiments described herein.

The slack off weight is the weight measured when the whole drillstring is moved down without rotation. In this case, the static friction is overcome and a steady dynamic friction is counteracting the block down movement. The drillstring is partially compressed, and ideally, the compression is steady. FIG. 12 depicts an example of a slack off measurement according to one or more embodiments described herein. In this example, a slack off 1201 is detected and averaged 1202. The slack off value 1204 is then updated 1203.

Figure 13:
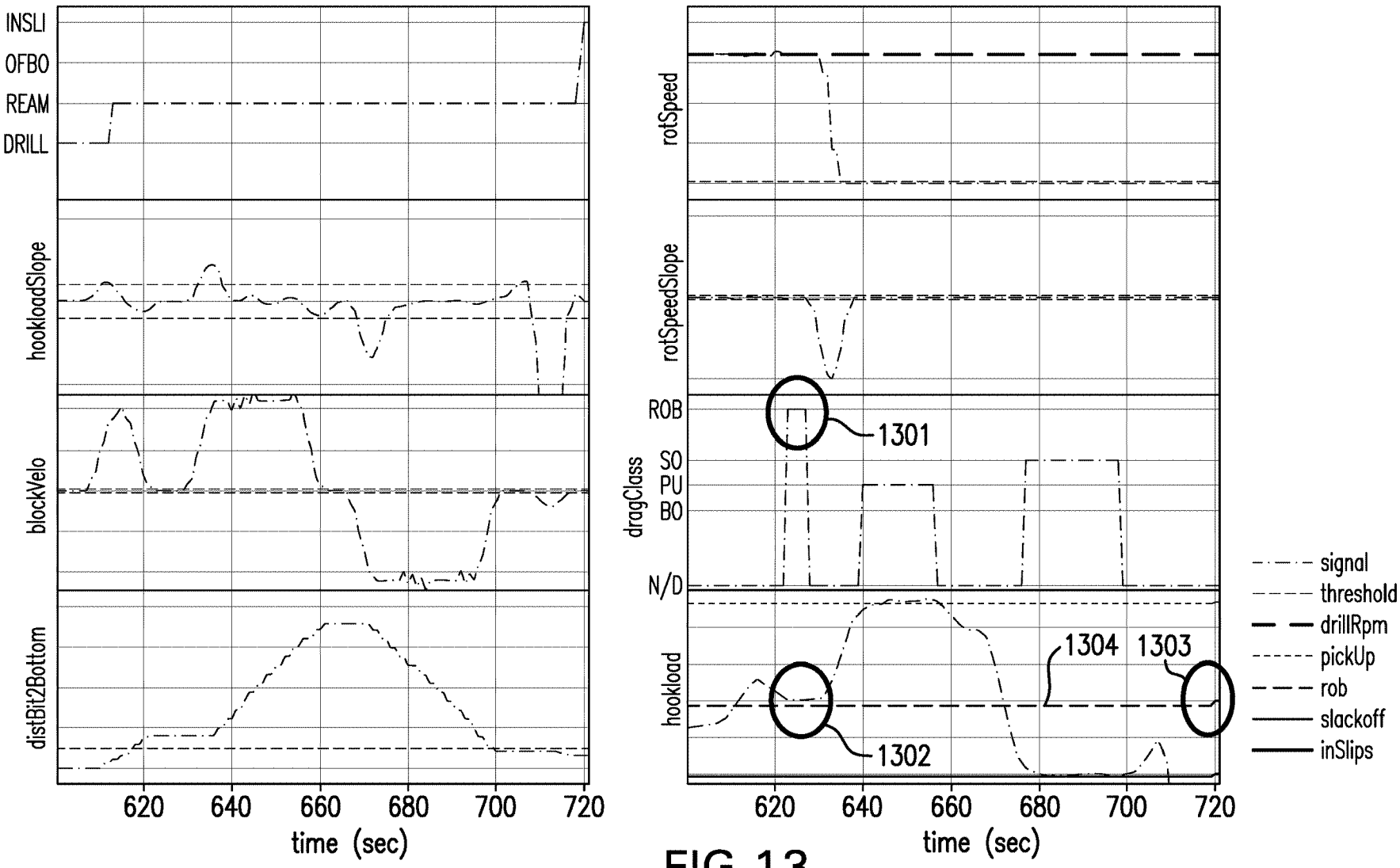
FIG. 13 depicts an example of a rotating off bottom drag measurement according to one or more embodiments described herein.

The rotating off bottom weight is the weight measured when the drillstring is not moved and rotating constantly close to the drilling rotary speed (or above a certain threshold when tripping or running the casing) and the drill bit is off bottom. FIG. 13 depicts an example of a rotating off bottom drag measurement according to one or more embodiments described herein. In this example, the rotating off bottom weight 1301 is detected and averaged 1302. The rotating off bottom value 1304 is then updated 1303.

The hookload for rotating off bottom also depends on whether the drillstring is in full tension (i.e., the block was moved up in advance) or in partial compression (i.e., the block was moved down in advance). In some of the friction tests, only one state (compression or tension) is detected. To cover also the cases where both states are detected, the averaging time (1302) is chosen to be very long to determine a mean value for both states during on friction test (connection procedure). In some examples, the sequential friction tests are performed similarly so the trend of the rotating off bottom weight is plausible.

Figure 14:
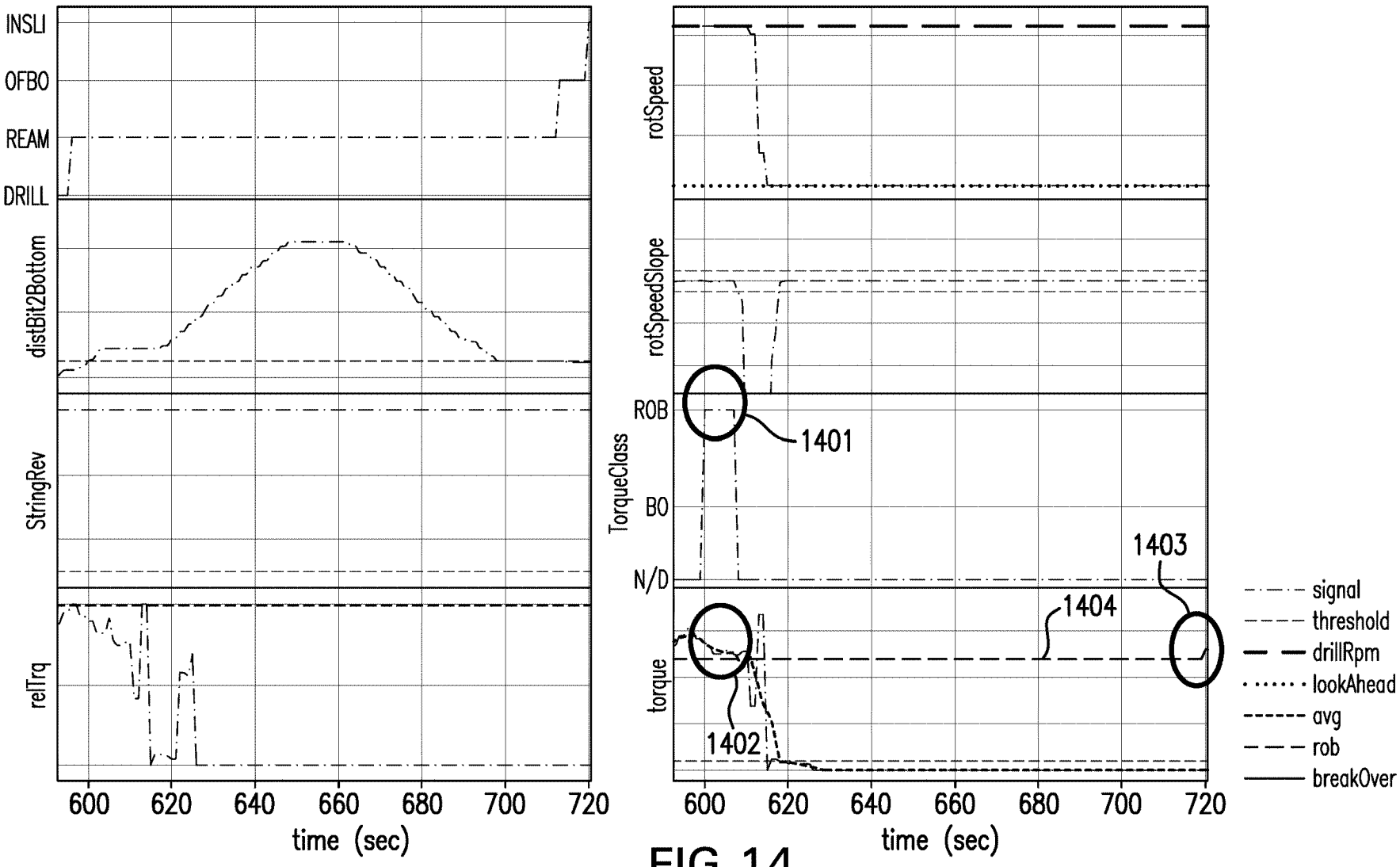
FIG. 14 depicts an example of a rotating off bottom torque measurement according to one or more embodiments described herein.

The rotating off bottom torque is the torque measured when the drillstring is rotating constantly close to the drilling rotary speed (or above a certain threshold when tripping or running in the casing) and the drill bit is off bottom. FIG. 14 depicts an example of a rotating off bottom torque measurement according to one or more embodiments described herein. In this example, the rotating off bottom torque 1401 is detected and averaged 1402. The rotating off bottom torque value 1404 is then updated 1403.

Figure 15:
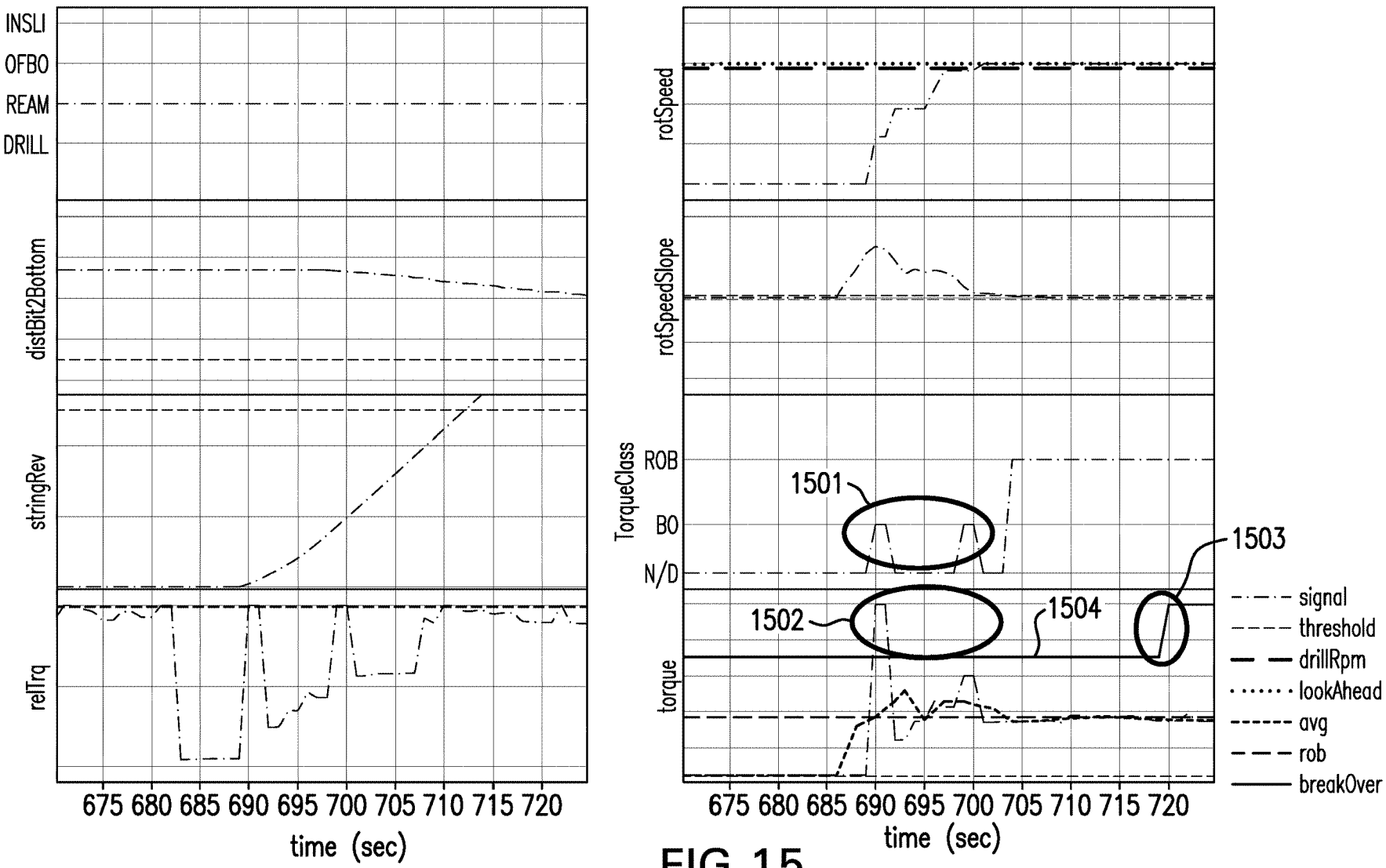
FIG. 15 depicts an example of a break over torque measurement according to one or more embodiments described herein.

The break over torque is the torque peak measured when the drillstring starts rotating and overcomes the static friction between the drillstring and the borehole while the bit is off bottom. FIG. 15 depicts an example of a break over torque measurement according to one or more embodiments described herein. In this example, break over torque 1501 is detected and the maximum/peak 1502 is determined. The break over torque value 1504 is then updated 1503.

Example embodiments of the disclosure include or yield various technical features, technical effects, and/or improvements to technology. Example embodiments of the disclosure provide technical solutions for autonomous torque and drag monitoring by modeling (estimated) torque and drag parameters, acquiring measured torque and drag parameters during upstream well construction operations, interpolating friction factors for the measured torque and drag parameters, transposing the interpolated fraction factors into a time-based series, and using the interpolated friction factors and/or time-based series to determine when to take a correction action. The techniques described herein for autonomous torque and drag monitoring improve drilling technologies by sampling torque and drag parameters more accurately and faster than can practically be done manually and implementing corrective actions based thereon. Accordingly, drilling decisions can be made more accurately and faster, thus improving drilling efficiency, reducing non-production time, improving hydrocarbon recovery, and the like.

Set forth below are some embodiments of the foregoing disclosure:

Embodiment 1: A method for performing autonomous four-dimensional torque and drag monitoring, the method comprising modeling at least one torque and drag parameter for an upstream well construction operation; acquiring at least one measured torque and drag parameter during performing the upstream well construction operation; interpolating friction factors at different sampling times for the at least one measured torque and drag parameter; transposing the friction factors at the different sampling times for the at least one measured torque and drag parameter to a time-based series; and performing a corrective action responsive to determining that one or more of the friction factors at a particular point in time is indicative of the one or more of the friction factors deviating from an expected value.

Embodiment 2: A method according to any prior embodiment, wherein at least one torque and drag parameter is selected from a group comprising a pickup weight measurement, a pickup breakover weight measurement, an overpull weight measurement, a slack off weight measurement, a slack off break over weight measurement, a rotating off bottom weight measurement, a rotating off bottom torque measurement, and a break over torque measurement.

Embodiment 3: A method according to any prior embodiment, wherein the corrective action is selected from a group consisting of adjusting a drilling trajectory, adjusting a weight on a drill bit, adjusting the flow rate, adjusting the mud viscosity and adjusting a rotation rate of the drill bit.

Embodiment 4: A method according to any prior embodiment, wherein the deviating from the expected value is a range check bounded by a lower limit threshold and an upper limit threshold.

Embodiment 5: A method according to any prior embodiment, wherein at least one of the lower limit threshold and the upper limit threshold is set based on an expected behavior of the upstream well construction operation, and wherein any points falling outside the range defined by the lower limit threshold and the upper limit threshold is a symptom of a dysfunction of the upstream well construction operation.

Embodiment 6: A method according to any prior embodiment, wherein at least one of the lower limit threshold and the upper limit threshold is adjustable.

Embodiment 7: A method according to any prior embodiment, wherein performing the corrective action is performed in real-time or near-real-time while performing the upstream well construction operation.

Embodiment 8: A method according to any prior embodiment, wherein the at least one measured torque and drag parameter is acquired by one or more measurement devices in place at a surface or disposed in a bottom hole assembly downhole in a borehole of the upstream well construction operation.

Embodiment 9: A method according to any prior embodiment, wherein the interpolating is performed using theoretical hookload and torque data.

Embodiment 10: A system comprising a memory comprising computer readable instructions; and a processing device for executing the computer readable instructions, the computer readable instructions controlling the processing device to perform operations comprising: modeling at least one torque and drag parameter for an upstream well construction operation; acquiring at least one measured torque and drag parameter during performing the upstream well construction operation; interpolating friction factors at different sampling times for at least one measured torque and drag parameter; transposing the friction factors at the different sampling times for at least one measured torque and drag parameter to a time-based series; and performing a corrective action responsive to determining that one or more of the friction factors at a particular point in time is indicative of the one or more of the friction factors deviating from an expected value.

Embodiment 11: A system according to any prior embodiment, wherein the at least one torque and drag parameter is selected from a group comprising a pickup weight measurement, a pick up breakover weight measurement, an overpull weight measurement, a slack off weight measurement, a slack off breakover weight measurement, a rotating off bottom weight measurement, a rotating off bottom torque measurement, and a break over torque measurement.

Embodiment 12: A system according to any prior embodiment, wherein the corrective action is selected from a group consisting of adjusting a drilling trajectory, adjusting a weight on a drill bit, adjusting the flow rate, adjusting the mud viscosity and adjusting a rotation rate of the drill bit.

Embodiment 13: A system according to any prior embodiment, wherein the deviating from the expected value is a range check bounded by a lower limit threshold and an upper limit threshold, wherein at least one of the lower limit threshold and the upper limit threshold is set based on an expected behavior of the upstream well construction operation, wherein any points falling outside the range defined by the lower limit threshold and the upper limit threshold is a symptom of a dysfunction of the upstream well construction operation, and wherein at least one of the lower limit threshold and the upper limit threshold is adjustable.

Embodiment 14: A system according to any prior embodiment, wherein performing the corrective action is done in real-time or near-real-time while performing the upstream well construction operation, and wherein the at least one measured torque and drag parameter is acquired by one or more measurement devices in place at a surface or disposed in a bottom hole assembly downhole in a borehole of the upstream well construction operation.

Embodiment 15: A system according to any prior embodiment, wherein the at least one measured torque and drag parameter is used to determine pipe stretch.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A method for performing autonomous four-dimensional torque and drag monitoring, the method comprising:

defining one or more torque and drag classes during performing an upstream well construction operation;

modeling, for the one or more defined torque and drag classes of the upstream well construction operation, a first modeled torque and drag value by using a first preselected friction factor and a second modeled torque and drag value by using a second preselected friction factor;

acquiring, during performing the upstream well construction operation, a first measured torque and drag value and a measured torque and drag class of the upstream well construction operation, wherein the measured torque and drag class is one of the one more or more defined torque and drag classes;

determining a first interpolated friction factor based on the first measured torque and drag value, the first modeled torque and drag value and the second modeled torque and drag value; and performing a corrective action based on the first interpolated friction factor and the measured torque and drag classes.

2. The method of claim 1, wherein the one or more defined torque and drag classes is selected from a group consisting of a pickup weight measurement, a pickup breakover weight measurement, an overpull weight measurement, a slack off weight measurement, a slack off break over weight measurement, a rotating off bottom weight measurement, a rotating off bottom torque measurement, and a break over torque measurement.

3. The method of claim 1, wherein the corrective action is selected from a group consisting of adjusting a drilling trajectory, adjusting a weight on a drill bit, adjusting a flow rate, adjusting a mud viscosity and adjusting a rotation rate of the drill bit.

4. The method of claim 1, further comprising:

determining a second interpolated friction factor based on a second measured torque and drag value; and transposing the first interpolated friction factor and the second interpolated friction factor to a time-based series for the one or more defined torque and drag classes.

5. The method of claim 4, wherein the performing the corrective action is responsive to determining that the first interpolated friction factor and the second interpolated friction factor in the time-based series is indicative of deviating from an expected value, and wherein the deviating from the expected value is a range check bounded by at least one of a lower limit threshold and an upper limit threshold.

6. The method of claim 5, wherein at least one of the lower limit threshold and the upper limit threshold is set based on an expected behavior of the upstream well construction operation, and wherein any points falling outside the range defined by the lower limit threshold and the upper limit threshold is a symptom of a dysfunction of the upstream well construction operation.

7. The method of claim 5, wherein at least one of the lower limit threshold and the upper limit threshold is adjustable.

8. The method of claim 1, wherein performing the corrective action is performed in real-time or near-real-time while performing the upstream well construction operation.

9. The method of claim 1, wherein the first measured torque and drag value is acquired by one or more measurement devices in place at a surface or disposed in a bottom hole assembly downhole in a borehole of the upstream well construction operation.

10. The method of claim 1, wherein the interpolating is performed using theoretical hookload and torque data.

11. A system comprising:

a memory comprising computer readable instructions; and a processing device for executing the computer readable instructions, the computer readable instructions controlling the processing device to perform operations comprising:

modeling, for one or more defined torque and drag classes of an upstream well construction operation, a first modeled torque and drag value by using a first preselected friction factor and a second modeled torque and drag value by using a second preselected friction factor;

acquiring, during performing the upstream well construction operation, a first measured torque and drag value and a measured torque and drag class of the upstream well construction operation, wherein the measured torque and drag class is one of the one more or more defined torque and drag classes; and determining a first interpolated friction factor based on the first measured torque and drag value, the first modeled torque and drag value and the second modeled torque and drag value, the first interpolated friction factor configured to be used to perform a corrective action based on the first interpolated friction factor and the measured torque and drag classes.

12. The system of claim 11, wherein the one or more defined torque and drag classes is selected from a group consisting of a pickup weight measurement, a pick up breakover weight measurement, an overpull weight measurement, a slack off weight measurement, a slack off breakover weight measurement, a rotating off bottom weight measurement, a rotating off bottom torque measurement, and a break over torque measurement.

13. The system of claim 11, wherein the corrective action is selected from a group consisting of adjusting a drilling trajectory, adjusting a weight on a drill bit, adjusting a flow rate, adjusting a mud viscosity and adjusting a rotation rate of the drill bit.

14. The system of claim 11, wherein performing the corrective action is done in real-time or near-real-time while performing the upstream well construction operation, and wherein the first measured torque and drag value is acquired by one or more measurement devices in place at a surface or disposed in a bottom hole assembly downhole in a borehole of the upstream well construction operation.

15. The system of claim 11, wherein the first measured torque and drag value is used to determine pipe stretch.

16. The system of claim 11, wherein the computer readable instructions controlling the processing device to perform further operations comprising:

determining a second interpolated friction factor based on a second measured torque and drag value; and transposing the first interpolated friction factor and the second interpolated friction factor to a time-based series for the one or more defined torque and drag classes.

17. The system of claim 16, wherein the performing the corrective action is responsive to determining that the first interpolated friction factor and the second interpolated friction factor in the time-based series is indicative of deviating from an expected value, and wherein the deviating from the expected value is a range check bounded by at least one of a lower limit threshold and an upper limit threshold.

18. The system of claim 17, wherein at least one of the lower limit threshold and the upper limit threshold is set based on an expected behavior of the upstream well construction operation, and wherein any points falling outside the range defined by the lower limit threshold and the upper limit threshold is a symptom of a dysfunction of the upstream well construction operation.

19. The system of claim 18, wherein at least one of the lower limit threshold and the upper limit threshold is adjustable.

* * * * *